US011491069B2

(12) United States Patent
Epureanu et al.

(10) Patent No.: US 11,491,069 B2
(45) Date of Patent: Nov. 8, 2022

(54) MULTIPLE ACTUATOR VIBRATION THERAPY

(71) Applicants: Bogdan I. Epureanu, Ann Arbor, MI (US); Kevin Ward, Superior Township, MI (US); Himanshu Saxena, Canton, MI (US); Mahmut Mert Egilmez, Plymouth, MI (US)

(72) Inventors: Bogdan I. Epureanu, Ann Arbor, MI (US); Kevin Ward, Superior Township, MI (US); Himanshu Saxena, Canton, MI (US); Mahmut Mert Egilmez, Plymouth, MI (US)

(73) Assignee: The Regents of the University of Michigan, Ann Arbor, MI (US)

( * ) Notice: Subject to any disclaimer, the term of this patent is extended or adjusted under 35 U.S.C. 154(b) by 225 days.

(21) Appl. No.: 15/904,337

(22) Filed: Feb. 24, 2018

(65) Prior Publication Data

US 2018/0243153 A1 Aug. 30, 2018

Related U.S. Application Data

(60) Provisional application No. 62/463,387, filed on Feb. 24, 2017.

(51) Int. Cl.
*A61H 1/00* (2006.01)

(52) U.S. Cl.
CPC ..... *A61H 1/005* (2013.01); *A61H 1/006* (2013.01); *A61H 2201/0142* (2013.01);
(Continued)

(58) Field of Classification Search
CPC ..... A61H 1/005; A61H 1/006; A61H 2201/0142; A61H 2201/0149;
(Continued)

(56) References Cited

U.S. PATENT DOCUMENTS 4,730,606 A * 3/1988 Leininger ..... A61H 1/008 602/33
6,200,282 B1 * 3/2001 Furuie ..... A61H 7/007 601/98

(Continued)

FOREIGN PATENT DOCUMENTS

CN 101132754 A 2/2008
CN 101222896 A 7/2008

(Continued)

OTHER PUBLICATIONS

Machine Translation of Japanese Patent Application Pub. No. 2004-033583 (Year: 2020).*

(Continued)

*Primary Examiner* — Bradley H Philips
*Assistant Examiner* — Savannah L Gabriel
(74) *Attorney, Agent, or Firm* — Lempia Summerfield Katz LLC

(57) ABSTRACT

A method includes disposing a plurality of actuators about a subject, each actuator being configured to generate a respective vibration signal, each vibration signal applying a normal force to the subject, and controlling the plurality of actuators such that the respective vibration signal of each actuator of the plurality has a respective vibration characteristic. Each actuator is oriented such that the respective vibration signal propagates along a longitudinal axis of the subject for stimulation of the subject remote from the plurality of actuators.

18 Claims, 8 Drawing Sheets

(52) U.S. Cl.
CPC ..... *A61H 2201/0149* (2013.01); *A61H 2201/0207* (2013.01); *A61H 2201/164* (2013.01); *A61H 2201/1614* (2013.01); *A61H 2201/1652* (2013.01); *A61H 2203/0431* (2013.01); *A61H 2203/0456* (2013.01); *A61H 2230/065* (2013.01); *A61H 2230/085* (2013.01); *A61H 2230/201* (2013.01); *A61H 2230/206* (2013.01); *A61H 2230/208* (2013.01); *A61H 2230/255* (2013.01); *A61H 2230/405* (2013.01); *A61H 2230/505* (2013.01)

(58) Field of Classification Search
CPC .... A61H 2201/0207; A61H 2201/1614; A61H 2201/164; A61H 2201/1652; A61H 2203/0431; A61H 2203/0456; A61H 2230/065; A61H 2230/085; A61H 2230/201; A61H 2230/206; A61H 2230/208; A61H 2230/255; A61H 2230/405; A61H 2230/505; A61H 1/00; A61H 1/008; A47C 21/006; A47D 9/02; B26B 9/22
See application file for complete search history.

(56) References Cited

U.S. PATENT DOCUMENTS

| | | | | |
|---|---|---|---|---|
| 6,328,759 | B1 * | 12/2001 | Zhang | A61H 1/0222 5/613 |
| 8,197,427 | B2 | 6/2012 | Ward et al. | |
| 2002/0068887 | A1 | 6/2002 | Kikumoto et al. | |
| 2003/0199795 | A1 * | 10/2003 | Leismer | A61H 1/006 601/23 |
| 2007/0004571 | A1 * | 1/2007 | Gonzalez | A63B 21/4005 482/124 |
| 2007/0089237 | A1 * | 4/2007 | Choy | A61B 5/4561 5/600 |
| 2008/0132813 | A1 * | 6/2008 | Katsuta | A61H 1/005 601/49 |
| 2008/0139979 | A1 * | 6/2008 | Talish | A61H 1/001 601/51 |
| 2010/0137750 | A1 * | 6/2010 | Grall | A61F 5/3769 601/1 |
| 2012/0209156 | A1 * | 8/2012 | Leismer | A61H 23/0263 601/49 |
| 2013/0072834 | A1 | 3/2013 | Afshar | |
| 2014/0276276 | A1 | 9/2014 | Kurosawa | |

FOREIGN PATENT DOCUMENTS

| | | | | |
|---|---|---|---|---|
| CN | 103736212 | A | 4/2014 | |
| CN | 204379719 | U | 6/2015 | |
| JP | 2004033583 | A * | 2/2004 | A61H 7/00 |
| KR | 101497926 | | 3/2015 | |
| WO | WO2006110545 | A2 | 10/2006 | |

OTHER PUBLICATIONS

International Search Report and Written Opinion in corresponding International Application No. PCT/US2018/019595, dated Aug. 22, 2018, 12 pages.

Blottner D, Salanov M, Puttmann B, et al, "Human skeletal muscle structure and function preserved by vibration muscle exercise following 55 days of bed rest", Eur J Appl Physiol 2006;97:261-271.

Boeselt T et al., "Whole-body vibration therapy in intensive care patients: A feasibility and safety study", Journal of Rehabilitation Medicine, vol. 48, No. 3 (2016), pp. 316-321.

Dickerson, Chris et al., "Immediate Effects of Localized Vibration on Hamstring and Quadricep Muscle Performance", International Journal of Sports Physical Therapy, vol. 7, No. 4 (2012), pp. 381-387.

Herterich J., Schnauber H, "The Effects of Vertical Mechanical Vibration on Standing Man", Journal of Low Frequency Noise, Vibration and Active Control, vol. 11, No. 2 (1992), pp. 52-61.

Lee, Meng-Chih et al., "Effect of 6 Months of Whole Body Vibration on Lumbar Spine Bone Density in Postmenopausal Women: A Randomized Controlled Trial", Clinical Interventions in Aging, vol. 8, (2013), pp. 1603-1609.

Maloney-Hinds, Colleen et al., "The Role of Nitric Oxide in Skin Blood Flow Increases Due to Vibration in Healthy Adults and Adults with Type 2 Diabetes", Diabetes Technology & Therapeutics, vol. 11, No. 1 (2009), pp. 39-43.

Morton, R Hugh and Cochrane, Darryl J., "Is there an optimal whole-body vibration exposure 'dosage' for performance improvement?", International Journal of Exercise Science, vol. 7, No. 3 (2014), pp. 169-178.

Rittweger J., "Vibration as an exercise modality: how it may work, and what its potential might be.", European Journal of Applied Physiology, vol. 108 (2010), pp. 877-904.

Salanova M, Gelfi C, Moriggi M., "Disues deterioration of human skeletal muscle challenged by resistive exercise superimposed with vibration: evidence form structural and proteomic analysis", FASEB J. 2014;28:4748-63.

Xueyan S. Xu, et al., "Vibrations transmitted from human hands to upper arm, shoulder, back, neck, and head", International Journal of Industrial Ergonomics, Accepted Jul. 1, 2016, Available online.

Cochrane, Darryl J. "The effect of vibration exercise on aspects of muscle physiology and muscular performance: a thesis submitted in partial fulfilment of the requirements for the degree of Doctor of Philosophy, Massey University, Palmerston North, New Zealand." (2010).

Elam, Austin, et al. "Advanced Space Health Maintenance System: Technology Enabling Extended Manned Space Exploration." Space 2005. 2005. 6788.

Wollersheim, Tobias, et al. "Whole-body vibration to prevent intensive care unit-acquired weakness: safety, feasibility, and metabolic response." Critical Care 21.1 (2017): 9.

International Preliminary Report on Patentability in International Application No. PCT/US2018/019595, dated Aug. 27, 2019, 8 pages.

First Office Action in Chinese Patent Application No. 201880013514.7, dated May 7, 2021, 20 pages (including English translation).

Second Office Action in Chinese Patent Application No. 201880013514.7, dated Nov. 15, 2021, 16 pages (including English translation).

Notification of Third Office Action in Chinese Patent Application No. 201880013514.7, dated Mar. 24, 2022, 13 pages (including English translation).

Rejection Decision in Chinese Patent Application No. 201880013514.7, dated Jul. 20, 2022, 14 pages (including English translation).

* cited by examiner

MULTIPLE ACTUATOR VIBRATION THERAPY

CROSS-REFERENCE TO RELATED APPLICATION

This application claims the benefit of U.S. provisional application entitled "Multiple Actuator Vibration Therapy," filed Feb. 24, 2017, and assigned Ser. No. 62/463,387, the entire disclosure of which is hereby expressly incorporated by reference.

BACKGROUND OF THE DISCLOSURE

Field of the Disclosure

The disclosure relates generally to vibration therapy.

Background

Muscle, nerve, and bone atrophy poses a significant risk for patients receiving critical care, such as mechanical ventilation, even for hospitalizations as short as one week. With over 4 million patients admitted to intensive care units (ICUs) yearly in the United States, and an average stay longer than 9 days in the ICU, the risk of muscle atrophy affects a significant number of people. In particular, treatment for sepsis may cause long stays in the ICU and often requires mechanical ventilation, resulting in nearly half of the over 1 million patients treated for sepsis developing muscle atrophy, and only half of sepsis survivors returning to work within one year of treatment. Muscle weakness following treatment from sepsis is believed to develop from a combination of reduced activity due to inactivity and the inflammation accompanying sepsis. Additionally, patients immobilized for long periods of time because of strokes, burns, and spinal cord injuries are also at risk of at risk.

Muscle atrophy from a variety of causes may be treated with aggressive physical therapy and early mobilization of patients. Such techniques are effective in reducing the length of time that patients receive mechanical ventilation and the length of hospitalization, though they require skilled physical therapists and may be difficult to apply to unconscious patients or patients otherwise unable to control their muscles. Further, applying these techniques at scale may be impractical due to the need for trained physical therapists and the risk that physical therapy poses to patients who are immobilized or mechanically ventilated.

Vibration therapy is another method of treating muscle atrophy and has been successful in improving muscle mass and function in patients with low levels of physical activity. Vibration therapy has been provided through soothing local massage effects in patients, often by vibrating an entire ICU bed, for instance, to loosen pulmonary secretions. Vibration therapy may be performed on patients who are acutely or chronically ill, immobilized, or unconscious with reduced manpower as compared to traditional physical therapy.

SUMMARY OF THE DISCLOSURE

In accordance with one aspect of the disclosure, a method includes disposing a plurality of actuators about a subject, each actuator of the plurality of actuators being configured to generate a respective vibration signal, each vibration signal applying a normal force to the subject, and controlling the plurality of actuators such that the respective vibration signal of each actuator of the plurality of actuators has a respective vibration characteristic. Disposing the plurality of actuators includes orienting each actuator of the plurality of actuators such that the respective vibration signal propagates along a longitudinal axis of the subject for stimulation of the subject remote from the plurality of actuators.

In another aspect, a system includes a plurality of actuators, each actuator of the plurality of actuators configured generate a respective vibration signal, each vibration signal applying a normal force to a subject, a harness arrangement configured to dispose the plurality of actuators about a longitudinal end of the subject and to orient each actuator of the plurality of actuators such that the respective vibration signal propagates along a longitudinal axis of the subject for stimulation of the subject remote from the plurality of actuators, and a controller in electrical communication with the plurality of actuators and configured to control a respective vibration characteristic of the respective vibration signal of each actuator of the plurality of actuators.

In yet another aspect, a method includes applying a compressive force to a subject along a longitudinal axis of the subject, disposing a plurality of actuators about a longitudinal end of the subject, each actuator of the plurality of actuators being configured to generate a respective vibration signal, each vibration signal applying a normal force to the subject, and controlling the plurality of actuators such that the respective vibration signal of each actuator of the plurality of actuators has a respective vibration characteristic, a respective vibration characteristic of a first actuator differing from a respective vibration characteristic of a second actuator. Disposing the plurality of actuators includes orienting each actuator of the plurality of actuators such that the respective vibration signal propagates along a longitudinal axis of the subject for stimulation of the subject remote from the plurality of actuators.

In connection with any of the aforementioned aspects (including, for instance, those set forth above in the Summary of Disclosure), the systems or methods may alternatively or additionally include any combination of one or more of the following aspects or features. The method further includes applying a compressive force to the subject along the longitudinal axis of the subject. The method further includes receiving, via a sensor disposed about the subject, a measure of a mechanical or physiological response and controlling the respective vibration characteristic of an actuator of the plurality of actuators based on the received measure. The measure of mechanical or physiological response includes but is not limited to tissue oxygen saturation, tissue blood flow, nitric oxide production, oxygen consumption, muscle or nerve electrical potential, bone growth, heart rate variability, tissue carbon dioxide levels, tissue temperature, or acceleration. The vibration characteristic of the vibration signal of a first actuator of the plurality of actuators differs from the vibration characteristic of the vibration signal of a second actuator of the plurality of actuators. The vibration characteristic is a vibration frequency or a vibration amplitude. The method further includes disposing the plurality of actuators further includes securing a harness arrangement to the subject, the harness arrangement configured to support the actuators oriented about the shoulders and plantar surfaces of the feet of the subject. The method further includes connecting actuators oriented about the shoulders of the subject and actuators oriented about the plantar surfaces of the feet of the subject via a compression link extending around an arm of the subject and along the length of the subject. The harness arrangement is further configured to dispose the actuators about the shoulders and plantar surfaces of the feet of the subject. The harness arrangement comprises and adjustable link configured to apply the compressive force. The system includes a compression link extending around an arm of the subject and along the length of the subject configured to connect the actuators disposed about the shoulders and the actuators disposed about the plantar surfaces of the feet of the subject. The system includes a sensor configured to measure a mechanical or physiological response, in which the controller is further configured to control the vibration characteristic of the vibration signal of an actuator of the plurality of actuators based on the received measure. The compressive force is applied via a preloaded harness arrangement in which disposing the plurality of actuators further includes disposing a first actuator of the plurality of actuators about the shoulders of a subject and disposing a second actuator of the plurality of actuators about the plantar surfaces of the feet of the subject, and in which controlling the plurality of actuators further includes exciting a first vibration signal with a first vibration characteristic frequency and amplitude via the first actuator of the plurality of actuators and a second vibration signal with a second vibration characteristic frequency and amplitude via the second actuator of the plurality of actuators. The method including receiving, via a sensor disposed about the subject, a measure of a mechanical or physiological response, and controlling the respective vibration characteristic of an actuator of the plurality of actuators based on the received measure.

BRIEF DESCRIPTION OF THE DRAWING FIGURES

For a more complete understanding of the disclosure, reference should be made to the following detailed description and accompanying drawing figures, in which like reference numerals identify like elements in the figures.

Figure 1:
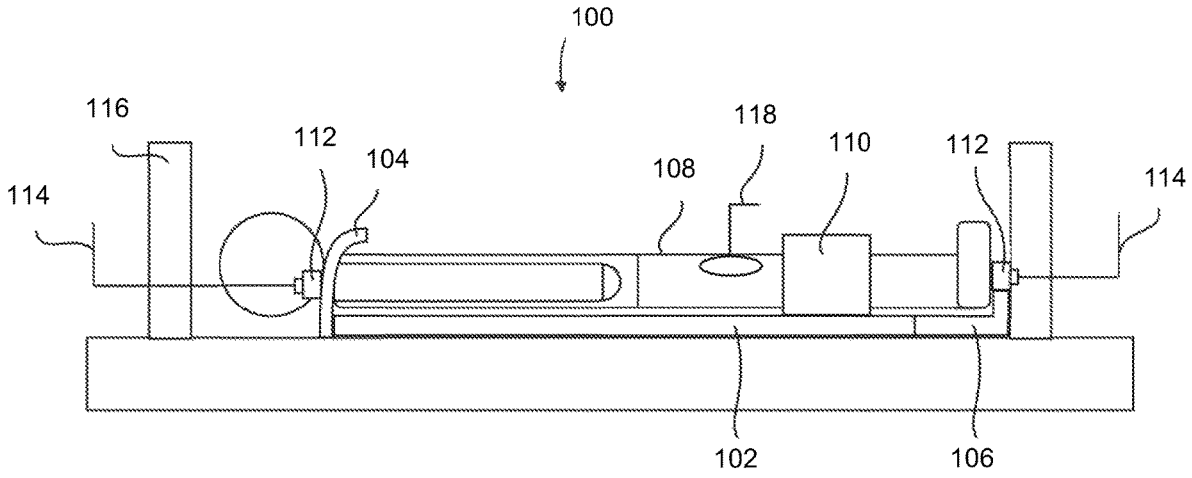
FIG. 1 is a schematic illustration of a vibration therapy system with multiple actuators in accordance with one example.

While the disclosed devices, systems, and methods are susceptible of embodiments in various forms, there are illustrated in the drawing (and will hereafter be described) specific embodiments of the invention, with the understanding that the disclosure is intended to be illustrative and is not intended to limit the invention to the specific embodiments described and illustrated herein.

DETAILED DESCRIPTION OF THE DISCLOSURE

Vibration therapy systems having multiple actuators are described, along with methods of controlling such systems. Vibration may be applied at various locations on a subject, based on the course of treatment. In one example, an adjustable harness arrangement, frame, or support may be arranged on the subject and configured to dispose the actuators at the various locations, reducing loss of vibration intensity as compared to vibration systems that vibrate the entire subject bed. Alternatively, the actuators may be supported separately from the harness arrangement, for instance, on a mobile frame, or integrated into a bed. In another example, the actuators are supported by mobile mounts that are separate from the harness arrangement when the harness arrangement is arranged on the subject. Mobile mounts and/or other actuator arrangements may be used without a harness arrangement.

Vibration may be applied through the plantar surfaces of the feet or the shoulders of the subject, or both, and/or at other locations, to provide vibration to part of or the whole body of the subject. Vibration may be applied as a force normal to the subject, and may propagate along a longitudinal axis (e.g., the axial skeletal spine) of the subject. Vibration may be applied to the subject for a predetermined or otherwise controlled period of time, for instance, five minutes.

Compression may be applied to the subject in addition to vibration. The adjustable harness arrangement may be used to apply a compressive force between the feet and shoulders of the subject, for example between a shoulder harness and foot supports that are elements of the harness arrangement. In some cases, the compressive force is applied on the upper body of the subject between the shoulder harness and a belt of the harness arrangement or on the lower body of the subject between the foot supports and the belt. The compressive force may apply pressure along a longitudinal axis (e.g., to or along the axial skeletal spine) of the subject through, e.g., bidirectional loading between the shoulders and feet of the subject. For instance, silicone rubber bands, tensioners, or other adjustable links of the harness arrangement may apply a preloading force to the harness arrangement. In another example, a ratcheting strap attached to the harness arrangement applies the compressive force to the harness arrangement. The system may thus be preloaded via the preloading force before application of the vibration. The adjustable links attached to the harness arrangement may be configured for different levels of resistance to apply different levels of compression in the subject. For example, a resistance level may be selected based on one or more characteristics of the vibration transmission or the condition of the subject.

The actuators may be configured to produce the same or different vibration frequencies or tones. In some examples, the actuators are configured for single tone excitation (STE). The actuators may apply a single vibration tone along the axial skeleton of the subject with a single frequency. In other examples, the actuators are configured for multiple frequency excitation (MFE). The actuators may apply different frequencies and/or at different amplitudes to multiple parts of the subject simultaneously. The vibration signals may differ in the amount of force the actuators apply to the subject. The actuators may be inertial or non-inertial (e.g. reactive) actuators.

Respective vibration frequencies may be used to produce distinct or particular effects on organs and tissues in the human body. The vibration therapy systems may be used to mitigate myopathy and enhance blood flow to tissues in a subject, acting as a resuscitative adjunct for tissues deprived of blood flow and oxygen. Frequencies falling in a range of about 7-15 Hz may increase oxygen of tissue hemoglobin in the upper body by about 11%, and frequencies falling in a range of about 5-70 Hz may increase oxygen of tissue hemoglobin in the lower body by about 10-50%. Respective operating frequencies may be used or selected based on the desired or particular frequency responses or resonant frequencies of target tissue (e.g. organs or muscles) in the subject. In one example, a vibration frequency of 15 Hz may be applied by a first actuator to target the upper body, while a second actuator simultaneously applies a 30 Hz vibration to target the lower body. Single tone excitation may cause an increase in tissue oxygenation more specific to the area of application of vibration Multiple frequency excitation may cause a greater overall increase in tissue oxygenation when compared to single tone excitation. Multiple frequency excitation may also account for asymmetric anatomical features of the subject that are not sufficiently vibrated by single tone excitation.

The harness arrangement may be configured to lock or isolate a joint of the subject to ensure (e.g., provide) efficient vibration propagation in the subject, e.g., in subjects that are unable to control their muscles. For instance, a brace or other stabilizing member may be applied around a knee of the subject to reduce vibration loss through the joint. In another example, the stabilizing member may be applied to the legs, the pelvis, or the torso of the subject. In some cases, the knee of the subject may not be locked. For example, joint locking may not be warranted in cases in which the limbs or other portions of the subject remain suitably in position. Joint locking may not be otherwise warranted if efficient vibration transmission is achieved without the harness arrangement, brace, or stabilizing member. The harness arrangement may be composed of a variety of rigid materials, including, for instance, carbon fiber, durable light plastics, and light metals.

The harness arrangement may be modular. For example, the harness arrangement may support the actuators and allow for a variety of actuator arrangements. Further, adjustable compression links, locking braces or other stabilizing members, sensors, or other therapeutic devices may be added or removed to the harness arrangement depending on various factors, including, for instance, aspects or characteristics of the vibration therapy treatment and/or the subject. The adjustable compression links may be added to a modular harness arrangement without braces, for example, in cases in which the subject is capable of controlling his or her muscles during the vibration therapy. In some cases, actuators may be disposed along one side of the harness arrangement only, for instance, to target one or more areas of the subject. The actuator arrangement may be otherwise asymmetrical.

Sensors may be integrated into the harness arrangement or placed on the subject to measure physiological or mechanical responses in the subject to the vibration therapy. For example, the sensors may be integrated into the shoulder or foot supports of the harness arrangement. The sensors may be any type of wearable body sensors for subject assessment and monitoring for physiological parameters. For example, the sensors may measure oxygen of the hemoglobin (e.g. tissue oxygenation), tissue blood flow, nitric oxide production, oxygen consumption, heart rate and variability, skin temperature, core temperature, blood flow, muscular or nervous electrical potential (e.g. electromyography), bone growth, heart rate variability, tissue carbon dioxide levels, tissue temperature, or acceleration. For example, a near infrared spectroscopic sensor may be used to detect tissue oxygen levels, or a piezoelectric sensor may measure acceleration. In another example, piezoelectric accelerometers and tissue oxygenation sensors are placed on a subject's body to personalize the vibration therapy based on the change in tissue oxygenation in response to vibration at various excitation amplitudes and frequencies. In a further example, an accelerometer or another sensor may be integrated into the harness arrangement to measure a response, for instance, vibration transmissibility. Additional sensors that relate changes in blood flow, metabolism, or activity to local tissues or the body as a whole which assist in guiding vibration therapy may be used to provide feedback and precision tuning of the vibration therapy. For example, such sensors may be cardiac output monitors, transcutaneous skin gas sensors, respiratory gas sensors, tissue impedance sensors, vascular tone sensors, and others.

The system may include a controller configured to automatically control the actuators based on the signal from the sensors. For instance, the controller may adjust the frequency and/or amplitude of vibrations generated by the actuators. The adjustments may be based on tissue oxygen levels as measured by tissue oxygenation sensors (e.g. near infrared spectroscopy tissue oxygenation sensors). For instance, the adjustments based on the data from sensors may allow for personalized medicine and optimization of therapy with regard to the body mass index, gender, comorbidity, or target organ of the subject. In some cases, tissue hemoglobin oxygen sensors placed on the calf and shoulder are used in conjunction with an accelerometer placed on the calf to personalize the vibration therapy for the subject. The controller may have a digital therapy control interface with capability for autonomous operation. Alternatively or additionally, the controller is configured to operate based on user input.

The controller may be configured to provide a closed-loop system. The controller may use a single or multiple parameter feedback protocol. The closed-loop system may use one or more sensors. The controller may communicate with the sensors in an autonomous, closed-loop system that operates according to one or more algorithms. The controller may continually or otherwise adjust treatment parameters such as vibration frequency, vibration amplitude, or treatment length during treatment, based on one or more feedback parameters. For instance, the frequency or amplitude of a vibration signal may be efficiently adjusted based on the data collected from the sensors on the subject.

The controller may stop vibration therapy when a parameter is outside of a specified range. The range may be predetermined or set for each subject individually. For instance, therapy may cease if a vital sign (e.g. heart rate and variability, blood pressure, or oxygen consumption) is above or below a safe range of values. For example, feedback indicating insufficient increase in the blood flow may require the system to extend the therapy period or increase the amplitude, which may cause other parameters to send stop signals such as due to a change in vital signs that might be considered unfavorable.

The vibration therapy system may be accompanied by other therapeutic devices, for example, a thermal pad, a pulsed electromagnetic field device including magnetic coils (e.g. for stimulating osteogenesis), a vascular occlusion or blood flow restriction device including bandages (e.g. for increasing muscle strength), or a transcutaneous electrical muscle stimulation device. Therapeutic devices may improve the efficiency or efficacy of the vibration therapy system and may be controlled by the controller of the vibration therapy system.

Although the vibration therapy systems and methods are described herein in connection with treatment of muscle loss, the disclosed systems and methods are useful in other contexts and applications. For example, the systems and methods may be used in aerospace applications to ensure health on long flights or trips for pilots or passengers. In other cases, the systems and methods may be used in office settings to prevent or reduce negative effects of sitting at a desk during work. In other cases, the systems and methods may be applied to treat other conditions, such as cardiovascular disease (e.g. cardiac arrest, peripheral vascular disease, cerebrovascular disease, and shock states such as sepsis and hemorrhages), for instance, due to the enhanced blood flow caused by vibration therapy. Other contexts in which the systems and methods may be useful include, for instance, modulating systemic hormones (cortisol and testosterone), improving balance, stability, gait, and mobility (e.g. in subjects suffering from Parkinson's disease and multiple sclerosis), improving reflex activity, proprioception, or metabolic activity, treating osteoporosis, improving bone mass, reducing bone loss (e.g. at the lumbar spine for postmenopausal women). In other cases, the systems and methods may be applied to athletes to improve performance or aid in recovery between workouts. For instance, the systems and methods may be used to increase the strength and other capabilities of athletes.

FIG. 1 depicts a vibration treatment system 100 in accordance with one example. The system 100 may be used, for example, to mitigate myopathy and enhance blood flow to tissues in a subject 108, such that the system 100 may be a resuscitative adjunct for tissues deprived of blood flow and oxygen. In this example, the system 100 includes a harness arrangement 102 with shoulder supports 104 and foot supports 106. The harness arrangement may be placed around the subject 108.

The harness arrangement 102 may include a stabilizing member 110 for locking or isolating a joint of the subject 108, for example a knee. The stabilizing member 110 may be or include a brace. The locking may improve transmission of vibration signals throughout the body by, e.g., reducing the vibration absorbed through the joint. The harness arrangement 102 may also be used without the stabilizing member 110. The harness arrangement 102 may be built from a variety of materials, for instance, carbon fiber, durable light plastics, and light metals.

The system 100 includes a number of vibration actuators 112. In this example, the vibration actuators 112 are disposed near the shoulders of the subject 108 or the plantar surfaces of the feet, or both. The actuators 112 may be supported by the harness arrangement 102. The vibration actuators 112 contain electrical leads 114 for connection to amplification and control circuitry. Additionally or alternatively, the vibration actuators 112 may communicate wirelessly with the control circuitry. In some cases, the vibration actuators 112 have a battery and onboard amplifier and communicate wirelessly with a controller.

The actuators 112 may be enclosed in a housing. The housing may facilitate the cleaning and reuse of the system 100. For example, each housing may be cleaned between uses or subjects. Each housing may enclose one or more actuators. Additionally or alternatively, the housing may contain a battery, wireless communication circuitry, an amplifier, and a cooling system. For example, the housing may contain a fan, blower, or be in contact with a liquid jacket or gaseous cooling system. The housing may be sealed with an O-ring. The O-ring may maintain the air integrity of the housing or mitigate contamination of the actuator within.

Adjustable compression links (not shown) may be attached to the harness arrangement 102 to apply compressive force to the subject 108 along a longitudinal axis of the subject 108. For example, compression may be applied along the axial spine of the subject 108. Compression may also be applied between the shoulders and feet of the subject 108. The compression links may be made out of silicone, rubber, rope, webbed nylon, or other non-rigid materials. For example, the compression links may be silicone bands. The links may have adjustable resistance levels to set the amount of compression applied to the subject 108 or to provide consistent compression across different configurations of the harness arrangement. For example, a ratchet or crank may adjust the compression applied by the link. In some cases, the amount of compression applied may be chosen based on the target tissue in the subject 108 or based on physical characteristics of the subject 108 such as gender, body mass index, or other physiological considerations. Compression may be applied to the upper and lower parts of the body of the subject 108 individually and independently. For example, a higher level of compression may be applied to the upper body than the lower body (e.g. a higher level of compression between the waist and the shoulder of the subject 108 than between the waist and the feet of the subject 108). In another example, compression may be applied only between the shoulders and the waist of the subject 108, or only between the feet and the waist of the subject 108. Instead of or in addition to adjustable compressive links, the compressive force may be applied by a hydraulic, mechanical, or magnetic system. The compression may be applied along the length of the harness arrangement and may use an external stationary point or object (e.g. the frame or rail of the bed).

The vibration actuators 112 produce respective vibration signals. Each vibration signal may apply a normal force. For instance, the force may be normal to the surface of the subject 108 in the vicinity of the position at which the actuator 112 is disposed. The actuators 112 are configured to apply vibration along a longitudinal axis of the subject 108, for example from the shoulders of the subject 108, from the plantar surfaces of the subject's feet, or from both. Other locations may be used. The vibration actuators 112 may be placed directly against the skin of the subject 108, or may indirectly contact the subject 108 through fabric, pads, or other items. The actuators 112 may be inertial or non-inertial (e.g. reactive) actuators.

A sensor 118 may be placed on the subject 108 or integrated into the harness arrangement 102 to measure a physiological or mechanical response in the subject 108. Any number of sensors may be included. For example, the sensor 118 may be integrated into the shoulder support 104 or the foot support 106. The sensor 118 may be any type of wearable body sensor for subject assessment and/or monitoring of physiological parameters. For example, the sensor 118 may measure a physiological response by hemoglobin oxygen saturation level in the tissue or blood, tissue blood flow, nitric oxide production, oxygen consumption, bone growth, heart rate variability, tissue carbon dioxide levels, tissue temperature, muscle response with electromyography, or nerve response with electroneurography. In other cases, the sensor 118 may be an accelerometer for measuring tissue acceleration, vibration transmission, or another mechanical response. The sensors may, for example, be placed at various locations, such as on the calf, thigh, chest, or other anatomical positions of the subject 108. The sensor 118 may be electrically connected to the controller or may have a wireless connection. The sensor 118 may be configured to harvest vibrational energy from the subject 108, for example, to power the sensor or a connection between the sensor and the controller. Additionally or alternatively, the sensor may be battery powered.

Figure 2:
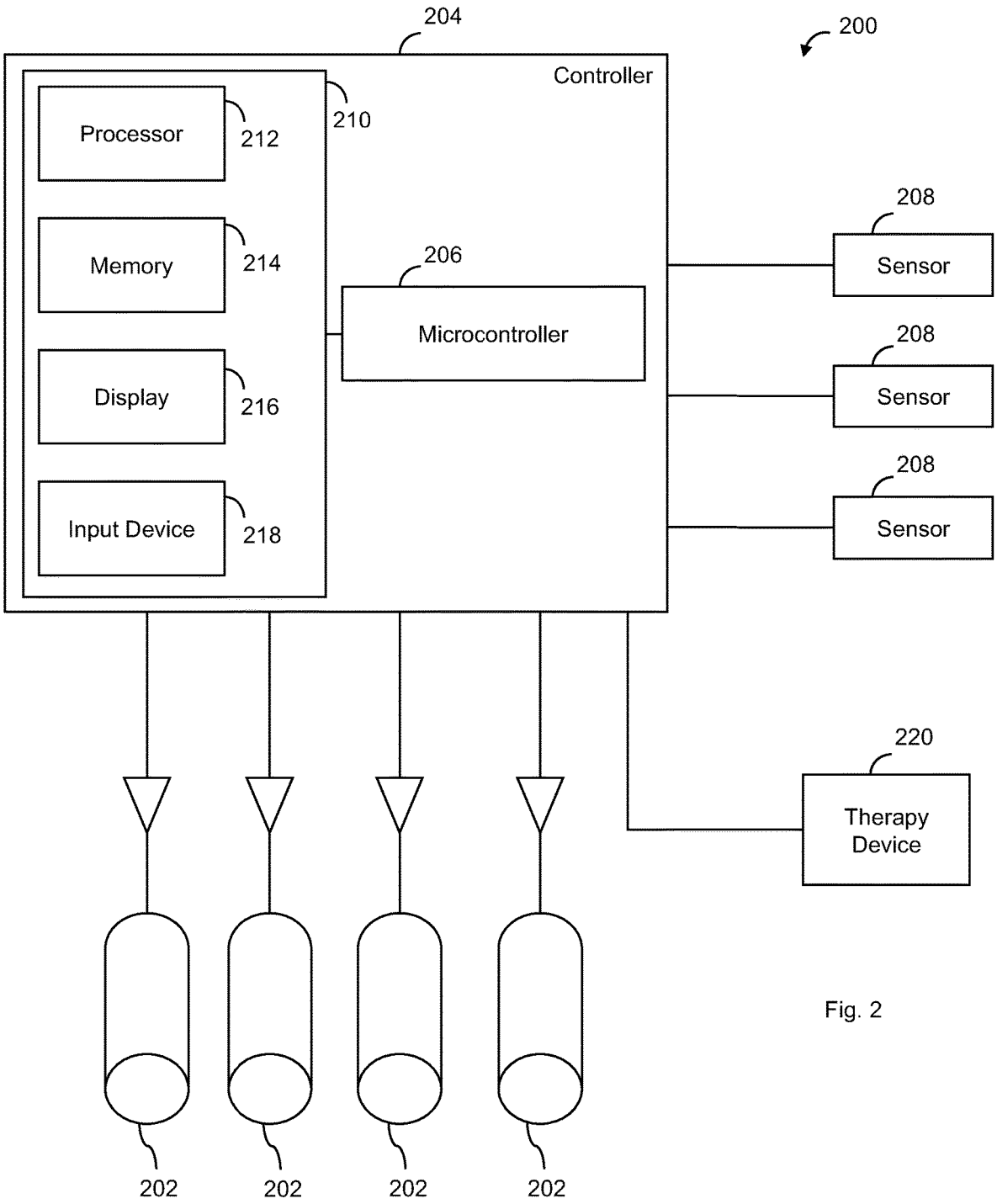
FIG. 2 is a block diagram of a vibration therapy system with multiple actuators in accordance with one example.

FIG. 2 depicts a block diagram of a vibration treatment system 200. The vibration treatment system 200 may include, be a component of, be used in conjunction with, correspond with, or be integrated to any desired extent with, the system 100 of FIG. 1. The system 200 includes a number of vibration actuators 202 and a controller 204. In this example, the vibration actuators 202 are connected to the controller 204 via respective amplifiers. The controller 204 may include a microcontroller(s) 206 configured to communicate with the actuators 202.

The system 200 further includes a number of sensors 208. The sensors 208 are configured to provide information regarding the subject to the controller 204. Various types of sensors 208 may be used. Communications with the sensors 208 may be supported by the microcontroller 206 and/or another component of the controller 204.

The controller 204 may use the input from the sensors 208 to control one or more vibration characteristics of the vibration actuators 202 (and/or the vibration signal(s) generated thereby). The vibration characteristic may be a frequency or amplitude of vibration, or a duration of vibration therapy. The controller 204 may act automatically, and/or in accordance with user input from the input device 218, control the vibration characteristic. For instance, the controller 204 may adjust the vibration characteristic based on tissue oxygenation in the subject, allowing for vibration therapy that may be personalized to the particular subject. The controller 204 may operate all the actuators 202 to produce a single vibration signal (e.g., a single tone, or STE), or the vibration actuators 202 may be operated to produce two or more vibration signals simultaneously or intermittently (e.g. MFE). The vibration actuators 202 may generate multiple signals from the same side of the subject or from opposed sides (or ends) of the subject. The controller 204 may select the vibration characteristic based on the frequency response or the resonant frequency, in cases in which, for instance, the frequency response or the resonant frequency of target tissue is known. The controller 204 may select the vibration characteristic based on the frequency response or the resonant frequency of tissue and/or other factors, such as the configuration of the actuators 202 or subject information (e.g. height, weight, hydration level, or body composition). For example, the controller 204 may select different vibration characteristics for different vibration actuator 202 to account for an asymmetric anatomy of the subject.

The controller 204 may be configured to provide a closed-loop control system. The controller 204 may use single or multiple parameter feedback control. The controller 204 may operate according to one or more control procedures configured to implement the closed-loop control system.

Other types of control procedures may be alternatively or additionally implemented. For example, the controller 204 may adjust (e.g., efficiently adjust) the vibration characteristic(s) based on information from the sensors 208 distributed about the subject. The controller 204 may stop therapy if a parameter is outside a specified range of acceptable values. For example, the controller 204 may stop the actuators 202 if a vital sign of the subject is above or below a safety threshold.

The actuators 202 may be distributed about the subject. In some cases, one or more of the actuators 202 are supported by a harness arrangement, frame, or other support placed around the subject. Alternatively or additionally, mobile mounts may support one or more of the actuators 202, in the presence or absence of a harness arrangement or frame. Other types of support structures may be used.

The actuators 202 may be configured to generate and/or apply vibration to a part or whole of the subject's body. In some cases, the vibration is applied at or through the plantar surfaces of the feet and the shoulders of the subject. The actuators 202 may apply vibration as a normal force to the subject. The actuators 202 may be oriented such that the vibration propagates along an axial skeletal spine and/or other longitudinal axis of the subject.

The actuators 202 may be configured to generate the vibration signal at the same or different frequencies. In STE cases, the actuators 202 are configured to apply a vibration tone with a single frequency. In MFE cases, the actuators 202 may be configured to apply multiple vibration tones at different vibration frequencies, amplitudes, or forces simultaneously. For example, actuators 202 in MFE examples may apply one vibration signal at 15 Hz and another signal at 30 Hz at the same or different locations on the body of the subject by one or more vibration actuators 202. Other vibration signal scenarios may be applied. For example, the actuators 202 may be configured to sequentially apply vibration signals at one or more subject locations at the same frequency or different frequencies.

The configuration of the actuators 202 may vary. For instance, the actuators 202 may be inertial actuators or non-inertial (e.g. reactive) actuators.

The sensors 208 are communicatively connected to the controller 204. The sensors 208 may be distributed at different locations on the subject. For example, one of the sensors 208 may include an accelerometer placed on the calf of the subject and configured to measure hemoglobin oxygen levels. In other cases, one or more of the sensors 208 are disposed at other locations, such as the thigh or chest or other anatomical positions of the subject.

The sensors 208 and actuators 202 may be or include digital or analog sensors. The sensors 208 may be configured to measure various physiological or mechanical responses in the subject. For example, the sensors 208 may measure oxygen of tissue hemoglobin (e.g. tissue oxygenation), nitric oxide production, oxygen consumption, heart rate and variability, skin temperature, core temperature, tissue blood flow, muscular or nervous electrical potential (e.g. electromyography), bone growth, heart rate variability, tissue carbon dioxide levels, tissue temperature, or acceleration. For example, one or more of the sensors 208 may be configured as or include a near infrared spectroscopic sensor may be used to detect tissue oxygen levels. Alternatively or additionally, one or more of the sensors 208 may be configured as or include a piezoelectric sensor to measure acceleration. In another example, the sensors 208 include both a piezoelectric accelerometer and tissue oxygenation sensors. These sensors 208 are placed on a body of a subject to personalize the vibration therapy based on the change in tissue oxygenation in response to vibration at various excitation amplitudes and frequencies. The sensors 208 may be connected to the controller 204 by an electrical connection, an optoelectronic connection, or wirelessly. For example, the sensors 208 may include a power supply to power the wireless connection between the sensors 208 and the controller 204.

In the example of FIG. 2, the controller 204 includes an operator workstation 210. The operator workstation 210 may include a processor 212, memory 214, a display 216, and an input device 218. The processor may be a general-purpose processor. The input device 218 may be or include a keyboard and/or other input interface to provide a digital therapy control interface for accepting user input. Alternatively or additionally, the controller 204 is configured for autonomous operation based on the data from the sensors 208.

The microcontroller 206 may include one or more processors, one or more memories, one or more digital-to-analog converters, and one or more analog-to-digital converters. The microcontroller 206 may be configured to receive instructions from the workstation 210 and to generate digital or analog control signals that are sent to the actuators 202 to control the vibration characteristic of the actuator 202.

The controller 204 may also be connected to a therapy device 220. The therapy device 220 may be, for example, a thermal pad, a pulsed electromagnetic field device (e.g., including magnetic coils), a vascular occlusion or blood flow restriction device (e.g., including restrictive bandages), or a transcutaneous electrical muscle stimulation device. The therapy device 220 may be a standalone device or be integrated to any desired extent with the harness arrangement 102, a bed, a chair, the stabilizing members, or the joint brace. The therapy device 220 may be controlled by the controller 204 in conjunction with the actuators 202, based on feedback from the sensors 208. For example, vibration therapy with the therapy device 220 configured for transcutaneous electrical muscle stimulation may be optimized for a subject based on data from a tissue hemoglobin oxygen sensor 208. In another example, the therapy device 220 is a thermal pad, the sensor 208 is a temperature sensor, and the controller 204 is configured to increase the temperature of the subject prior via the thermal pad 220 prior to applying vibration via the actuators 202, and to maintain a specified temperature for the duration of the vibration therapy.

Figure 3:
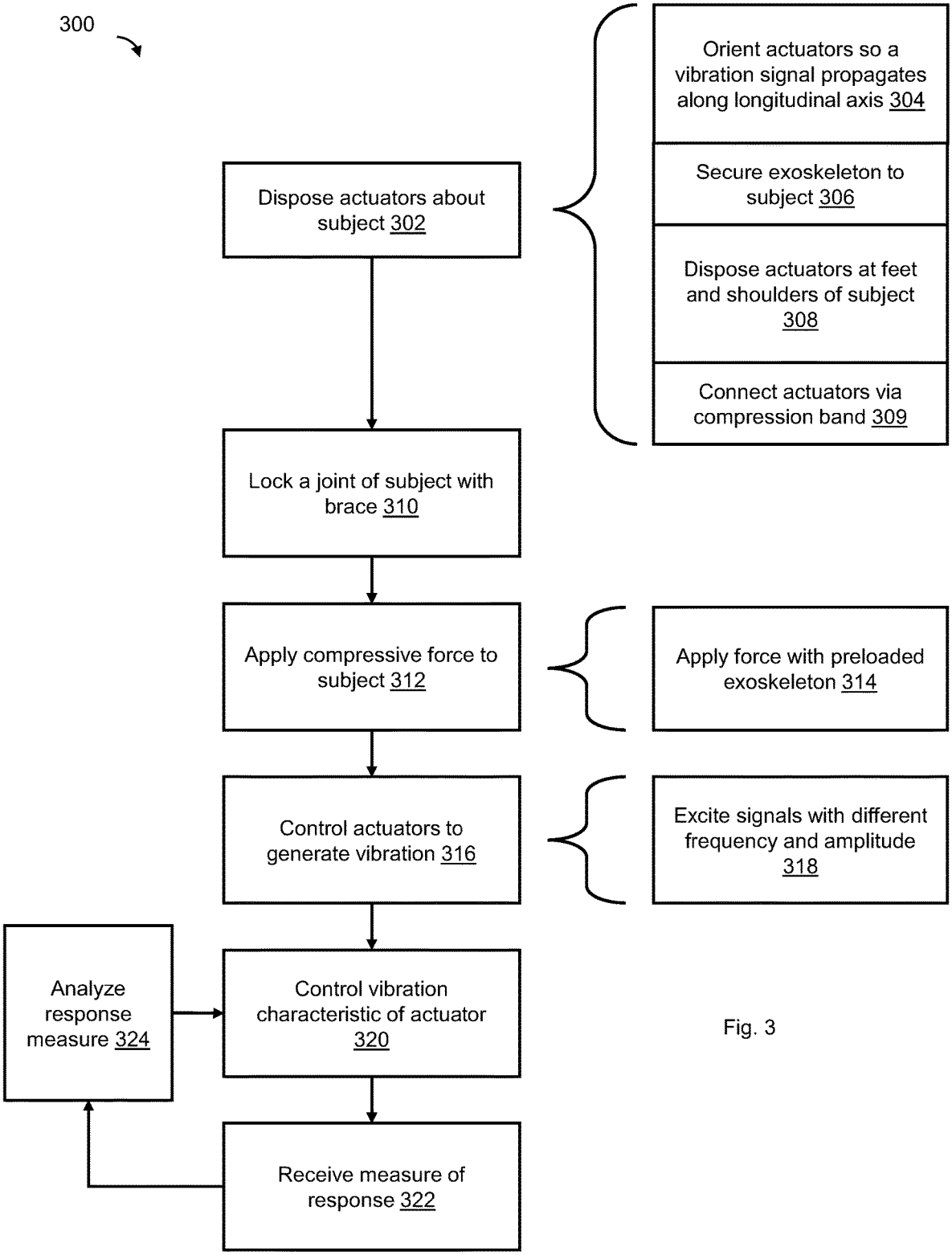
FIG. 3 is a flow diagram of a method of providing vibration therapy in accordance with one example.

FIG. 3 depicts a flow diagram of a method 300 of providing vibration therapy. The method 300 may be implemented in whole or in part by the processor of the controller 204 (FIG. 2), the microcontroller 206, any other component of the system 100 (FIG. 1) or the system 200 (FIG. 2), or any other processor or controller. For example, the processor may be configured, via execution of the control instructions stored in the memory, to cause the processor to implement the method 300. The method may be implemented in additional or alternative ways. For instance, the method may be implemented by a remote processor, such as a processor in communication with the processor of the controller 204.

The method 300 includes an act 302 in which the actuators are disposed about the subject. The actuators may be disposed in a variety of arrangements. In some cases, the act 302 includes an act 304 in which the actuators are oriented so that a vibration signal propagates along the longitudinal axis of the subject. The longitudinal axis may align with the axial skeletal spine of the subject.

Alternatively or additionally, the act 302 includes an act 306 in which the harness arrangement is secured to the subject. The harness arrangement may be modular and include shoulder supports, foot supports, a back support, stabilizing members or joint braces, and adjustable compression links. The harness arrangement may support the actuators disposed about the subject. The harness arrangement may be separate from or an element of the bed or chair.

The actuators are disposed on the subject in act 308. In some cases, the actuators are disposed at the feet of the subject, the shoulders of the subject, or both. Alternative or additional locations may be used. There may be one actuator at each location, or multiple actuators at each location (e.g., at the feet or shoulders). In some cases, one or more of the actuators may be supported by the foot supports and shoulder supports of the harness arrangement. In those or other cases, one or more of the actuators may be supported by a mobile mount or integrated into the chair or bed.

In some cases, the actuators are connected to one another via a compression link in act 309. The compression link extends along the length of the subject. The compression link may also extend around one or more body parts, such as the arms, shoulders, and feet. The link may or may not be elastic. In the former case, the compression link may be applied by stretching the link to engage the subject. In the latter case, the compression link may be shortened via, e.g., ratcheting or cranking. In other cases, the link does not stretch and shortening the length of the link applies compression to the subject through the harness arrangement.

The compression link may include multiple components. For example, one component may connect to the actuator at the shoulder of the patient and form a loop through which an arm of the patient may be disposed. Another component may connect the loop to the actuators at the feet of the patient. In some cases, the compression link extends between supports for the actuators at the shoulders of the subject and a shoe supporting the actuators at the feet of the subject. The compression link may allow for a specified amount of compression to be applied to the subject. Further details regarding the compression link are set forth below in connection with the example of FIG. 10. The compression link may alternatively or additionally be applied in connection with an act 312 described below.

One or more joints of the subject may be locked in act 310. The act 310 may include applying a brace or other stabilizing member to the subject. The brace may help avoid joint flexure or other movement that would otherwise occur with, for instance, application of the compressive force. For example, the compressive force may cause flexure of the knees in the absence of a brace disposed on the knees. The brace may be separate from, or a component of, the harness arrangement. The brace may be integrated with the harness arrangement, the bed, the chair, or another structure. The act 310 is optional. For example, the brace may not be warranted or used when the application of the compressive force in the act 310 does not result in joint movement. The knees or other joints of the subject may not move if, for instance, the weight of the legs or other body parts of the subject is sufficient to counteract the effect of the compressive force. In such and other cases, transmission of vibration signals throughout the body may be achieved without joint locking.

In act 312, compressive force is applied to the subject. The compressive force may be applied along the longitudinal axis of the subject. The compressive force, for example, may load and compress the axial skeletal spine of the subject. Compression may be applied to the upper and lower parts of the body of the subject individually and independently. For example, a higher level of compression may be applied to the upper body than the lower body (e.g. a higher level of compression between the waist and the shoulder of the subject than between the waist and the feet of the subject). In another example, compression may be applied only between the shoulders and the waist of the subject, or only between the feet and the waist of the subject. Instead of or in addition to adjustable compressive links, the compressive force may be applied by a hydraulic or magnetic system. The compression may be applied along the harness arrangement, and/or may use an external stationary point or object (e.g. the frame or rail of the bed). The amount and location of compression applied to the subject may be optimized according to the target tissue, subject characteristics such as gender or body mass index, and/or other considerations. In some cases, compression may be applied along a part of the longitudinal axis of the subject, for instance, between the shoulders and waist, or between the waist and feet of the subject. The level of compression may be set once or adjusted throughout the vibration therapy session, for example, based on the target tissue in the subject. In some cases, the act 312 includes an act 314 in which the compressive force is applied with a preloaded harness arrangement. Compressive force may be applied via the compressive links attached to the harness arrangement. In one example, the harness arrangement is or includes a medical brace that applies compression to the torso of the subject.

The actuators are controlled to generate vibration signal in act 316. The actuators may be controlled to generate signals with the same frequency and amplitude. In some cases, the act 316 includes an act 318 in which vibration signals with different frequency and amplitude are excited. The same or differing vibration signals may be simultaneously (e.g., substantially simultaneously), sequentially, intermittently, and/or otherwise applied to the subject. The signals may be applied by all of the actuators or subsets of the actuators.

In act 320, one or more vibration characteristics of the actuators are controlled. The controller 204 may control the vibration frequency, vibration amplitude, therapy duration, or other characteristic. The controller 204 may be configured to operate autonomously or may be configured to operate with user input. The control may be based on data from the sensors 208 connected to the controller 204. The vibration characteristics as well as other parameters, such as actuator position, may be selected or otherwise determined based on the target tissue in the subject. Controlling the vibration characteristic may occur in conjunction with controlling the operation of a therapy device, for example, a heating element placed on the subject or built into the harness arrangement, bed, or chair.

The frequencies and amplitudes of the actuators controlled in the acts 316, 318, and 320 may be selected based on the frequency response or the resonant frequency of tissue in the subject. The frequencies and amplitudes may also be selected on the location of target tissue in the subject or the position of the actuators. The frequency and amplitude adequate to vibrate target tissue may vary, for example, because use of a harness arrangement may increase the effect of vibration on remote regions of tissue in the subject.

The response of the subject to the vibration is measured and received in act 322. The response data may be collected by, and received from, one or more sensors in digital form and/or as an analog signal. The response data may indicate a physiological or mechanical response by the subject, including but not limited to oxygen of tissue hemoglobin (e.g. tissue oxygenation), oxygen consumption, heart rate and variability, skin temperature, core temperature, blood flow, muscular electrical potential (e.g. electromyography), or acceleration. The measurement data may be sent by from a sensor placed on the subject or integrated into the harness arrangement.

In act 324, the response measurement data is analyzed. The control of the vibration characteristic in the act 320 may be based on the analysis of the response measurement data in the act 324. For instance, when a response measurement data is above or below a threshold, the controller 204 may alter one or more vibration characteristics or other operational parameters (e.g., vibration duration) for one or more actuators. In some cases, the act 324 includes stopping vibration therapy when the response measurement data passes a threshold. The analysis in the act 324 may alternatively or additionally be used to control the operation of another therapeutic device used in conjunction with the vibration therapy device.

The acts of the method 300 may be performed in any order, e.g., not necessarily in the order presented in FIG. 3. For instance, compressive force may be applied to a subject prior to disposing the actuators about the subject. Additionally, acts may be omitted or repeated. For example, the collection and reception of the response measurement data in the act 322, and the analysis of the data in the act 324, may be repeated.

Figure 4:
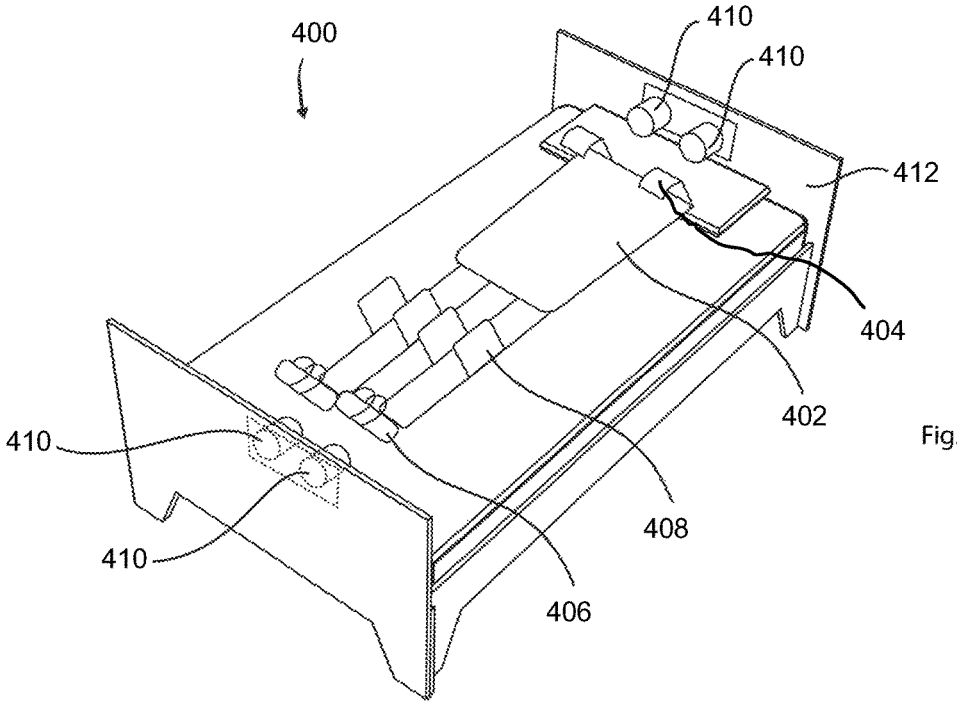
FIG. 4 is a schematic illustration of a vibration therapy system including a harness arrangement in accordance with one example.

FIG. 4 depicts an isometric view of a vibration therapy system 400 that includes a harness arrangement 402 having shoulder supports 404, foot supports 406, stabilizing members 408, and actuators 410. In this arrangement, the harness arrangement 402 includes an exoskeleton. In this case and other cases, the shoulder supports 404, foot supports 406, and stabilizing members 408 may be considered components or elements of the exoskeleton. The actuators 410 may be inertial or non-inertial (e.g. reactive) actuators. In one example, the harness arrangement 402 may be modular and allow for the removal or replacement of the various elements 404, 406, 408, 410. In this example, the harness arrangement is placed on a bed 412. Bed placement may reduce the difficulty of securing the harness arrangement 402 to a subject. In some cases, the actuators 410 are supported by the shoulder supports 404 and the foot supports 406. Additionally or alternatively, the actuators 410 are removably attached to the bed 412. For example, the actuators may be attached to the bed 412 via a bracket or hanger.

Figure 5:
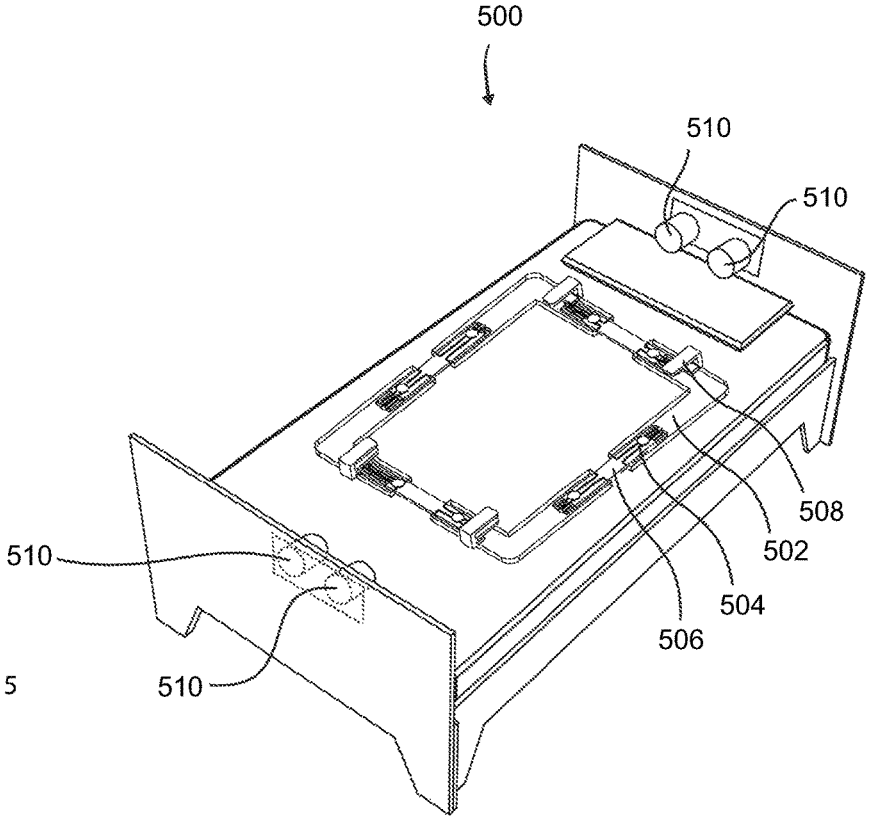
FIG. 5 is a schematic illustration of a vibration therapy system including a frame in accordance with one example.

FIG. 5 depicts a vibration therapy system 500 including a mobile frame 502. The mobile frame 502, which may be considered an exoskeleton, includes slidably mounted members 504 and 506 and actuator supports 508. The mobile frame 502 may support actuators 510 via the supports 508 to provide vibration to the subject. Additionally or alternatively, the actuators 510 are removably attached to the bed 512. For example, the actuators 510 may be attached to the bed 512 via a bracket or hanger. The actuators 510 may be inertial or non-inertial (e.g. reactive) actuators. The slidably mounted members 504 and 506 are configured to allow the mobile frame 502 to be adapted to different shapes and sizes, for instance, to accommodate different size subjects or to target different areas of a subject for vibration therapy.

The mobile frame 502 may include a lock or other mechanism to secure the slidable members 504 and 506 in place. For example, the mobile frame 502 may include a resistance fitting to secure the mobile frame 502 in a particular configuration while at rest, but to allow for a user to reconfigure the mobile frame 502 by exerting sufficient force on the mobile frame 502 to overcome the resistance. The mobile frame 502 may include a recess or may be entirely hollow as to allow the slidably mounted members 504 and 506 to be inserted into the mobile frame 502.

The mobile frame may include mounting points to allow for adjustable compressive links or other compressive elements to be fitted to the mobile frame 502. The addition of such compressive elements allows for a compressive force to be applied along the longitudinal axis of the subject.

Figure 6:
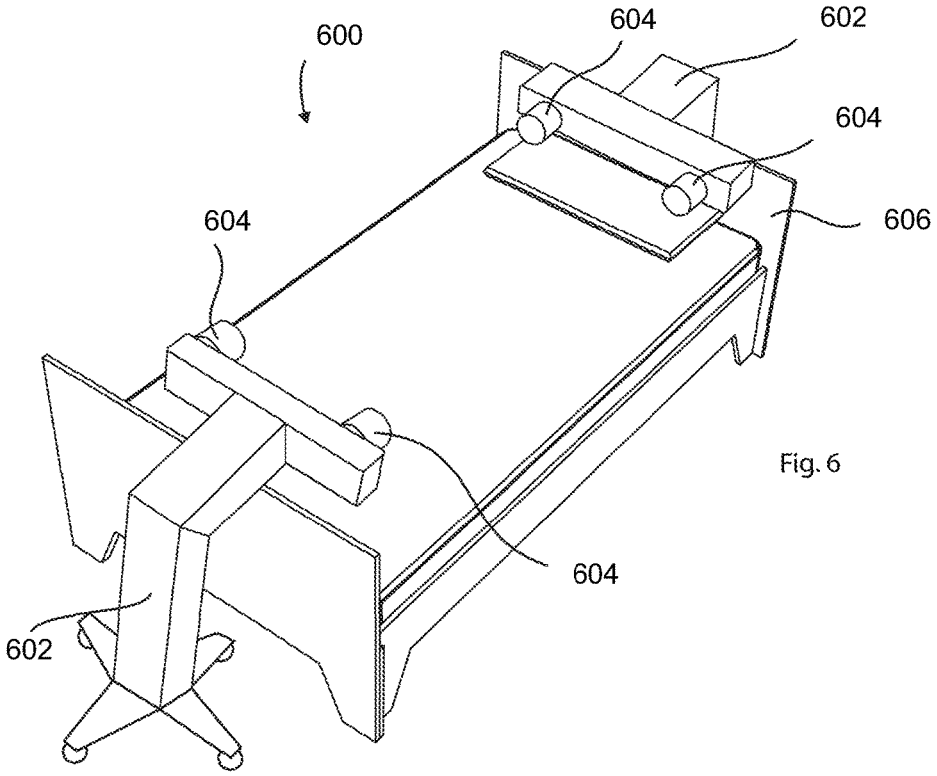
FIG. 6 is a schematic illustration of a vibration therapy system including mobile vibration actuators in accordance with one example.

FIG. 6 depicts a vibration therapy system 600 including mobile mounts 602 for the actuators 604. The actuators 604 may be inertial or non-inertial (e.g. reactive) actuators. The mobile mounts 602 support the actuators 604 and allow for convenient disposition of the actuators 604 about a bed 606. The mobile mounts may be used in conjunction with one or more exoskeleton elements (e.g. a mobile frame) or other harness arrangement. Castors or wheels may be mounted on the mobile mounts 602 and may lock so that the mobile mounts do not move during vibration therapy. The mobile mounts 602 may be adjustable to allow precise positioning of the actuators 604 about the subject.

Figure 7:
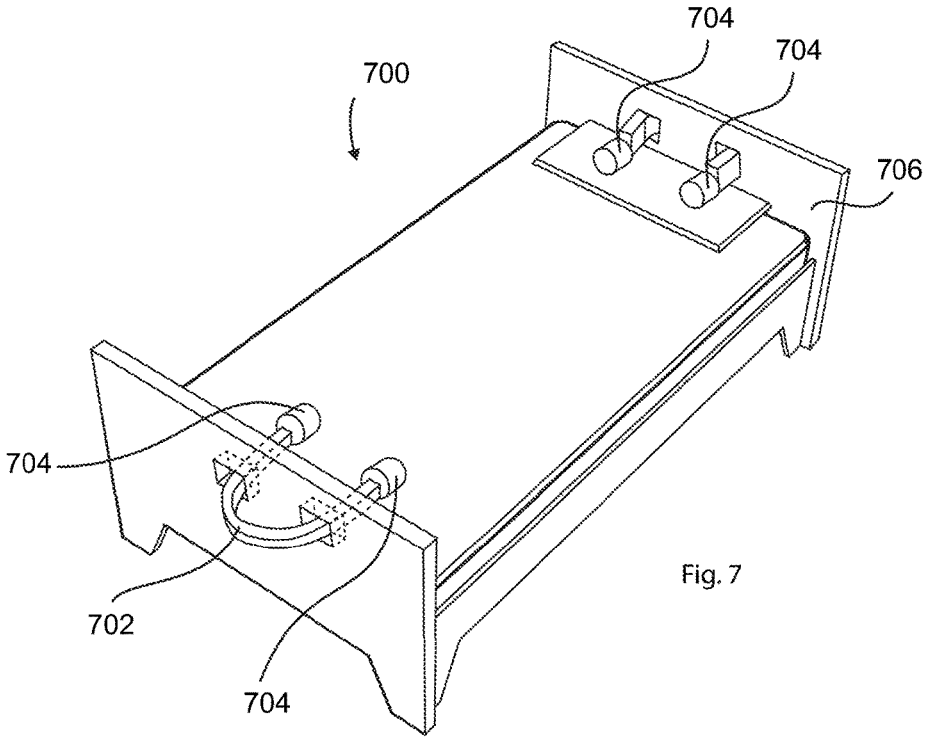
FIG. 7 is a schematic illustration of a vibration therapy system including a U-shaped mount in accordance with one example.

FIG. 7 depicts a vibration therapy system 700 including a U-shaped mount 702 for actuators 704. The actuators 704 may be inertial or non-inertial (e.g. reactive) actuators. The mount 702 may be integrated into a bed 706 or may be removably fixed to the patent bed 706. The mount 702 may be adjustably attached to the bed 706 and allow for precise positioning of the actuators 704 about the subject. The mount may be made out of a flexible material such that the mount may be configured to fit multiple beds 706 with different designs. For example, the mount 702 may be configured to attach to a bed with two passthroughs that are spaced apart by expanding the mount 702 such that the mount 702 is wide enough to fit through the passthroughs. The mount 702 may be made of a material that exhibits substantial elastic deformation such that the mount 702 exerts an inward pressure on a point where it contacts the bed 706. In another example, the mount 702 may be attached to the headboard or footboard of a bed 706 by a rigid adjustable attachment (e.g. a spring, rod, or rack and pinion gear arrangement). The rigid adjustable attachment may allow for the mount 702 to move in a vertical or horizontal direction. In some cases, arms of the mount 702 are adjustable by a crank and bring the actuators 704 into contact with the feet and shoulders of the subject. The crank may adjust the amount of compression applied by the mount 702 and actuators 704 to the subject.

Figure 8:
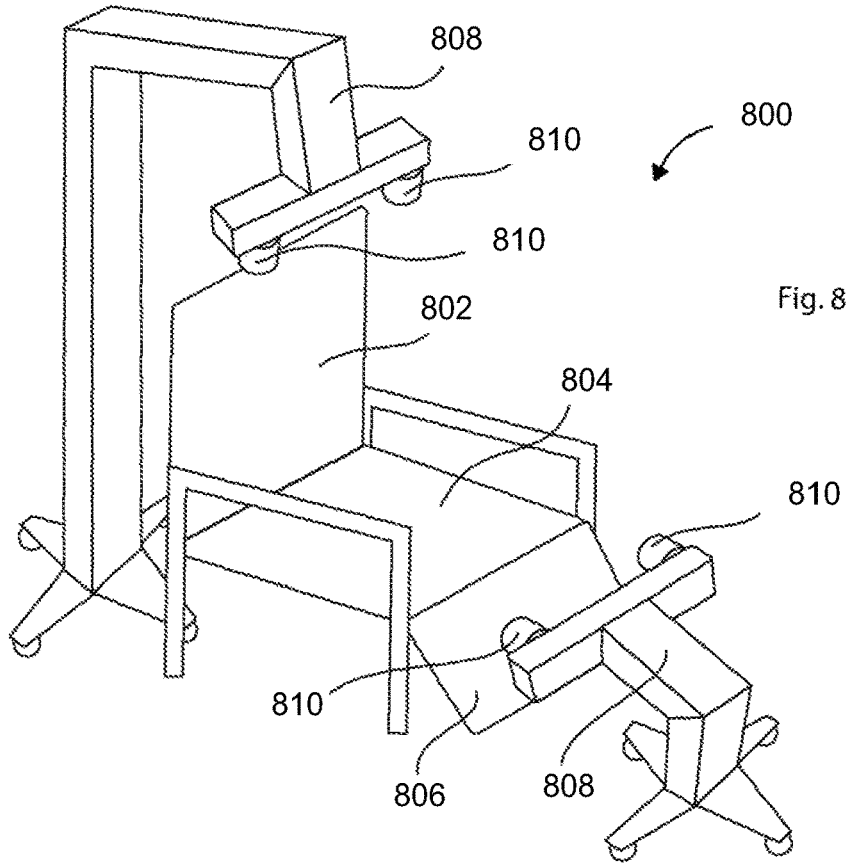
FIG. 8 is a schematic illustration of a vibration therapy system including an upright chair in accordance with one example.

FIG. 8 depicts a vibration therapy system 800 including a seat back 802, a seat bottom 804, and a foot rest 806 along with mobile mounts 808 for actuators 810. The actuators 810 may be inertial or non-inertial (e.g. reactive) actuators. Though the subject may be seated in such an arrangement, the mobile mounts 808 allow for vibration to be applied from the plantar surfaces of the subject's feet and from the subject's shoulders via actuators 810. Alternatively, the actuators 810 may be integrated into the therapy system 800, for instance, the seat back 802, the seat bottom 804, or the foot rest 806.

Separate compression elements may be applied to a subject in the therapy system 800 to provide for compressive force between the waist, buttocks, and shoulders of the subject, and between the waist, buttocks, and the feet of the subject. Alternatively, the compression elements may be attached to the system 800, for instance, the seat back 802, the seat bottom 804, or the foot rest 806. Additionally, a stabilizing member or brace may be attached to the foot rest 806 or other element of the system 800 to lock a joint of the subject. The system 800 may also be used without a stabilizing member or brace.

The seat back 802 may be raised so that the body of the subject forms multiple longitudinal axes. For example, for a subject sitting upright, there may exist a first longitudinal axis running through the axial skeletal spine, a second longitudinal axis running through the tibia, and a third longitudinal axis through the femur of the subject. Actuators 810 may be configured to apply vibration along either, or both, of the multiple longitudinal axes of the subject. The above identified embodiments may also be configured to apply vibration on multiple longitudinal axes, for instance, if the subject is reclined or sitting up in a subject bed.

The actuators 810 may be integrated into or disposed under the seat bottom 804. For example, the actuators 810 on the mobile mount 808 may apply vibration coaxially with the actuators 810 placed beneath the subject and may be a component of the seat bottom 804 or disposed under the seat, for instance, by a mobile mount 808. In another example, the previous configuration may be used in conjunction with a compressive force applied through the skeletal axial spine of the subject.

Figure 9:
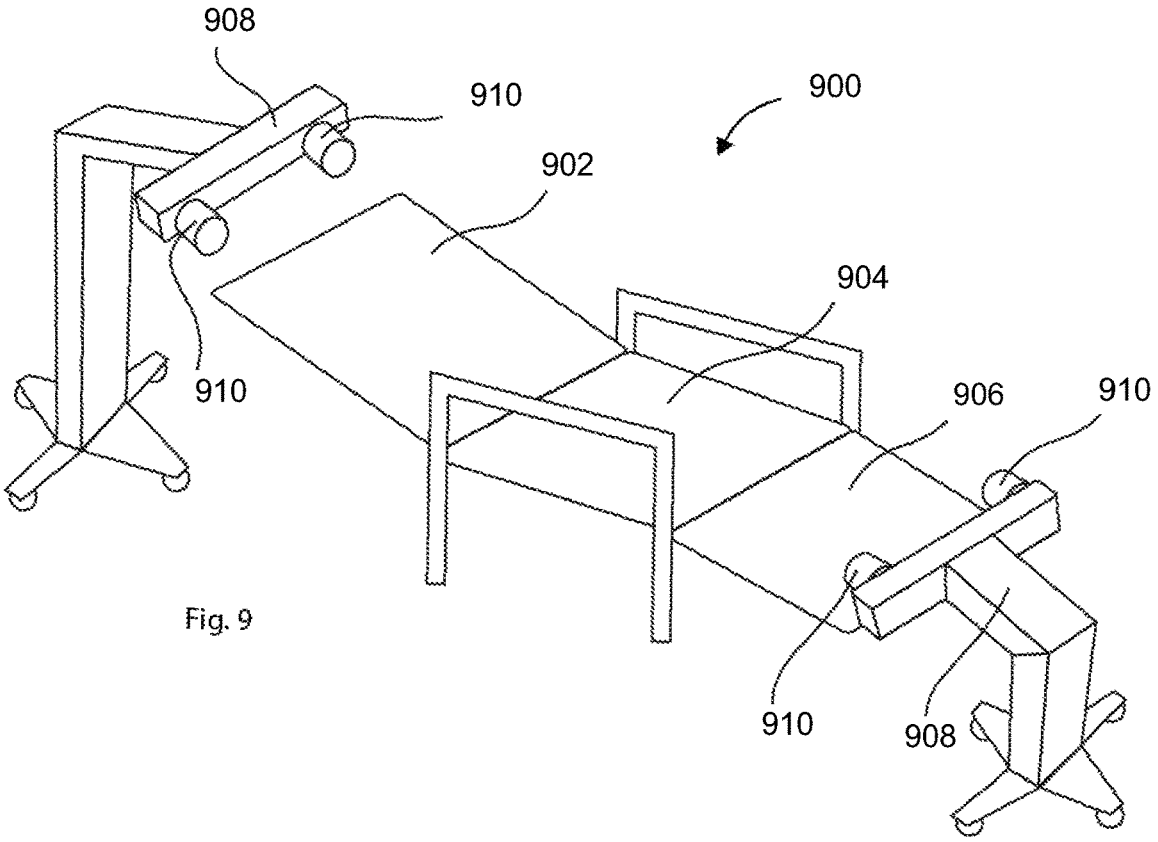
FIG. 9 is a schematic illustration of a vibration therapy system including a reclined chair in accordance with one example.

FIG. 9 depicts a vibration therapy system 900 including a seat back 902, seat bottom 904, and foot rest 906 along with mobile supports 908 for actuators 910. The actuators 910 may be inertial or non-inertial (e.g. reactive) actuators. The foot rest 906 may be configured to elevate the subject's legs above the subject's torso as supported by the seat back 902 and seat bottom 904, for instance, to improve blood flow to various parts of the subject's body. Mobile mounts 908 may allow for vibration to be applied from the plantar surfaces of the subject's feet and from the subject's shoulders. Alternatively, the actuators 910 may be integrated into the therapy system 900, for instance, the seat back 902, seat bottom 904, or foot rest 906.

Separate compression elements may be applied to a subject in the therapy system 900 to provide for compressive force between the waist and shoulders of the subject, and between the waist and the feet of the subject. Alternatively, the compression elements may be attached to the system 900, for instance, the seat back 902, the seat bottom 904, or the foot rest 906. Additionally, a stabilizing member or brace may be attached to the foot rest 906 or other element of the system 900 to lock a joint of the subject. The system 900 may also be used without a stabilizing member or brace.

The actuators 910 may be integrated into or situated under the seat bottom 904. For example, actuators 910 on mobile mount 908 may apply vibration coaxially with actuators 910 placed beneath the subject and may be a component of the seat bottom 904 or disposed under the seat, for instance, by a mobile mount 908. In another example, the previous configuration may be used in conjunction with a compressive force applied through the skeletal axial spine of the subject.

Figure 10:
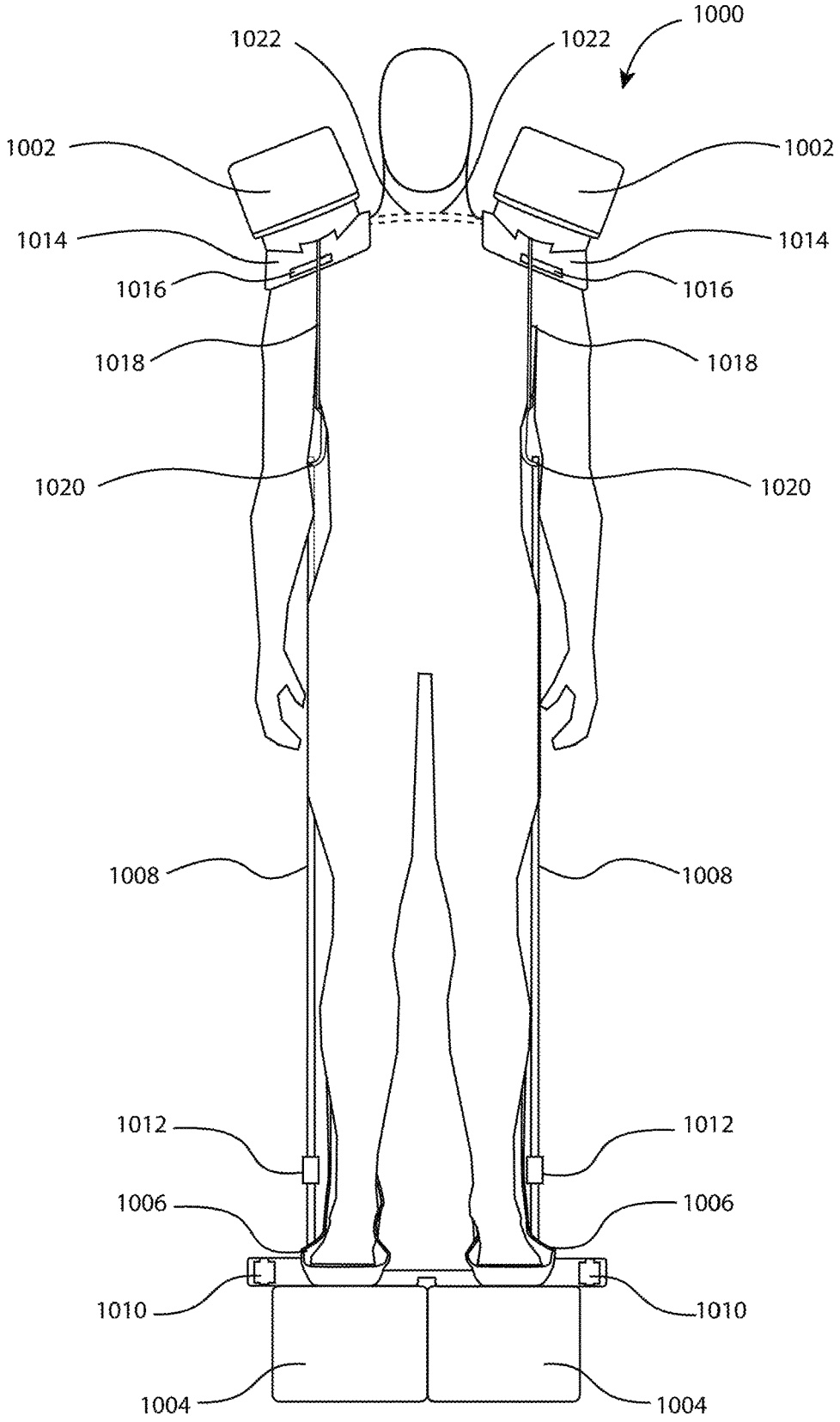
FIG. 10 is a schematic illustration of a vibration therapy system harness arrangement with multiple actuators in accordance with one example.

FIG. 10 depicts a vibration therapy system 1000. The system 1000 includes a harness arrangement. The harness arrangement may include an exoskeleton (or one or more exoskeleton elements). The harness arrangement of the system 1000 includes shoes 1006 and shoulder cups 1014. The system further includes vibration actuators 1002, 1004 arranged around the shoulders and feet of the subject. One or more actuators 1002 may be disposed at each shoulder of the subject. One or more actuators 1004 may be disposed at each foot of the subject. Additional, fewer, or alternative actuators may be disposed about the subject.

Each actuator 1002, 1004 may be enclosed in a housing as shown. The housing may facilitate the sterilizing or other cleaning of the system 1000. For example, each housing may be cleaned between uses or subjects. Each housing may enclose one or more actuators 1002, 1004. Additionally or alternatively, the housing may contain a battery, wireless communication circuitry, an amplifier, and a cooling system. For example, the housing may contain a fan, blower, or be in contact with a liquid jacket or gaseous cooling system. In some cases, the actuators 1002, 1004 communicate wirelessly with a controller. The housing may be sealed with an O-ring. The O-ring may maintain the air integrity of the housing or mitigate contamination of the actuator within.

The actuators 1004 may engage and/or be supported by a shoe(s) or boot(s) 1006 of the system 1000. The shoes 1006 may be considered to be an element of the harness arrangement of the system 1000. Additionally or alternatively, the shoes 1006 may be considered to be elements of the exoskeleton. Each shoe 1006 is configured to receive a respective foot of the subject. In the example shown, the shoe 1006 does not fully enclose the foot. The shoe may have an upper portion in other cases. The shoe 1006 secures the foot of the subject in position for the actuators 1004. Each shoe 1006 may be shaped or otherwise configured such that the sole (e.g., one or more plantar surfaces) of the foot of the subject is supported by the shoe 1006. The shoe 1006 may extend upward from the sole to provide or form an ankle brace.

Each shoe 1006 may include a rigid shell and a pad or other liner within the shell. The liner may be disposable and replaced after use. The liner may be custom fit for each subject via, for example, use of a moldable material. In some cases, the liner is made from a non-porous, closed cell foam. Additional or alternative customization of the shell, pad, or other aspect of the shoe may be provided via three-dimensional printing or other manufacturing techniques.

In the example of FIG. 10, the harness arrangement includes compression links 1008 that apply a compressive force to the subject along a longitudinal axis of the subject. The compression links 1008 apply compression along the axial spine of the subject. The compression links 1008 may attach to the shoe 1006 via slots 1010. The compression links 1008 may be made out of silicone, rubber, or other elastic materials. For example, the compression links 1008 may be silicone bands. Alternatively, the links 1008 may be made out of non-elastic materials such as webbed nylon, rope, or metal. In other cases, the compression links 1008 are non-elastic straps. The compression force provided by the compression links 1008 may be adjustable. The compression links 1008 may be adjustable to accommodate subjects of varying heights and/or different leg lengths. Additionally or alternatively, the compression links 1008 may be adjustable in length to establish a desired level of compression applied to the subject.

The compression force may be measured by an instrument 1012. The instrument 1012 may display the measured compression force and/or provide another output signal. For example, the instrument may be an analog gauge, a digital gauge, or a transducer. The instrument 1012 may be positioned in line with or as a component of the compression links 1008. Additionally or alternatively, the instrument 1012 may be a component of the shoe 1006 or the shoulder cup 1014. For example, the instrument 1012 may be integrally formed with the shoe 1006 or may fit between the slot 1010 in the shoe 1006 and the compression link 1008. In a further example, the instrument 1012 is integrally formed with the shoulder cup 1014 or fits between the slot 1016 in the shoulder cup 1014 and the clavicle strap 1018. In another example, the instrument 1012 forms a connection between the compression link 1008 and the slot 1010 in the shoe 1006. Multiple instruments 1012 may measure an amount of force applied to each side of the patient. For example, the instrument 1012 may be used to verify that compression is applied evenly to each side of the subject. Alternatively, the instrument 1012 may ensure that unequal load is applied to each side of the subject according to the course of treatment.

The actuators 1002 disposed around the shoulders of the subject may be supported by shoulder cups or other supports 1014. The shoulder cups 1014 may be considered to be elements of the harness arrangement. Additionally or alternatively, the shoulder cups 1014 may be considered to be elements of the exoskeleton. The shoulder cups 1014 may be configured to fit around or on top of the shoulders of the subject. Each cup 1014 may include an outer shell and an inner liner disposed between the shell and the shoulder of the subject. The outer shell may be composed of a rigid material. The liner may be composed of a foam or other compressible material. For example, the liner may be made from a non-porous, closed-cell foam. Additionally or alternatively, one or more components of the cup 1014 may be custom fit for each patient, for example, using a moldable material or an additive manufacturing technique. The shoulder cups 1014 may include an actuator base that supports the actuators 1002. The actuator base may allow for securing and removal of the actuator 1002 on the shoulder cup 1014. For example, the actuator base may be a two-piece construction where one piece is secured to the shoulder cup 1014, a second piece is secured to the actuator 1002 or a housing of the actuator 1002, and the two pieces fit together. The first piece of the actuator base may be integrally formed with the shoulder cup 1014. The second piece of the actuator base may attach to a housing of the actuator 1002 using threads or a latch. A seam where the second piece of the actuator base joins the housing may be sealed with an O-ring or gasket. The two pieces of the actuator base may fit together with a dovetail or other joint. The pair of shoulder cups 1014 may be combined in a one-piece construction to support multiple actuators 1004.

The vibration therapy system 1000 includes a clavicle strap 1018 to connect the shoulder cup 1014 to the compression link 1008. The shoulder cups 1014 may include a slot 1016 in which the clavicle strap 1018 is disposed. The slot 1016 in the shoulder cup 1014 allows for the clavicle strap 1018 to pass beneath the actuator base on the shoulder cup 1014. Each clavicle strap 1018 may loop around the shoulder and through the underarm region of the subject. In the example shown, the clavicle strap 1018 passes through the slot 1016 and over the shoulder of the subject. Alternatively or additionally, each clavicle strap 1018 may engage the shoulder cup 1014 via a hook or fastener. The clavicle strap 1018 may be secured to the compression link 1008 via a connector 1020, such as a carabiner or other coupling link. The clavicle strap 1018 may alternatively connect directly to the compression link 1008. The clavicle strap 1018 may be adjustable in length to accommodate different subject sizes and/or to adjust the compression force applied to the subject.

The connector 1020 may also support the adjustment of the compression force. For example, the connector 1020 may be shortened in length via a twisting, tightening, ratcheting, or other motion. Additional, fewer or alterative elements may be disposed between the compression link 1008 and the shoulder cup 1014. For instance, the connector 1020 and/or the clavicle strap 1018 may be integrated with the shoulder cup 1014 to any desired extent. In other cases, the connector is not used and the clavicle strap 1018 and compression link 1008 are integrated.

The shoulder cups 1014 may be connected to one another via one or more adjustable straps 1022 of the harness arrangement. The adjustable strap 1022 customized the spacing of the shoulder cups 1014. The strap 1022 may include a guide that allows the shoulder cups 1014 to slide closer or further apart along the guide. Wingnuts on the guide may secure the shoulder cups 1014 in position. Other fasteners and strap arrangements may be used. The strap 1022 may be located across the neck, chest, or back of the subject as shown in phantom in FIG. 10. The strap 1022 may reduce or prevent lateral or other displacement of the shoulder cups 1014 and the actuators 1002. The strap 1022 may be adjustable to allow for the shoulder cups 1014 to be fitted to a range of subjects. In some cases, the length of the strap 1022 and/or the connection points are adjustable.

Figure 11:
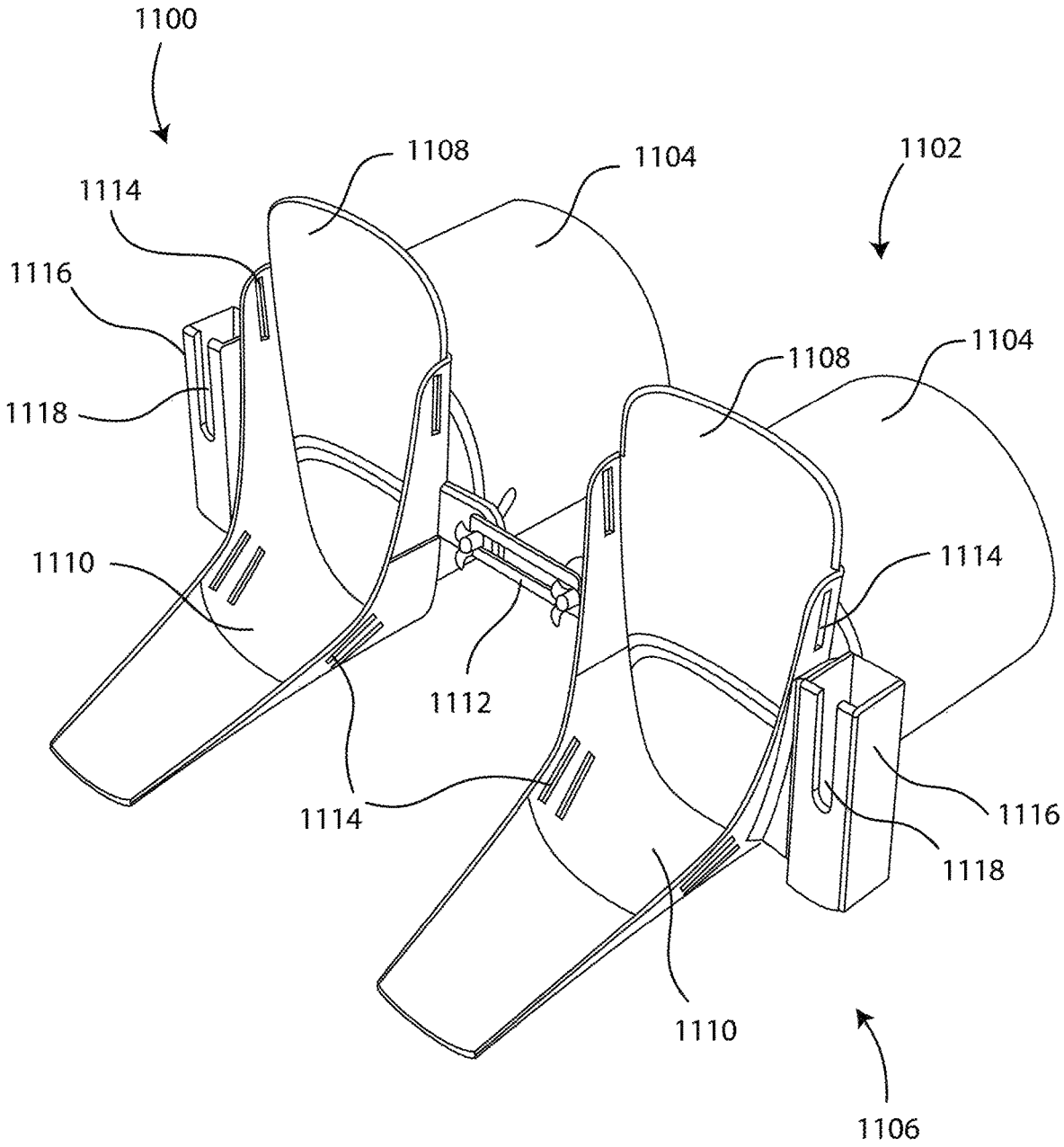
FIG. 11 is a schematic illustration of a foot vibration assembly of a vibration therapy system harness arrangement in accordance with one example.

FIG. 11 depicts a foot vibration assembly 1100 of a harness arrangement. The foot vibration assembly 1100 may be used with, or be a component of, any of the above-described vibration therapy systems or harness arrangements. Alternatively, the foot vibration assembly 1100 may be an element of another vibration therapy system, such as one having actuators disposed only at the feet. The foot vibration assembly 1100 includes vibration actuators 1102 disposed at the feet of a subject. In this example, each actuator 1102 is enclosed in a respective housing 1104. In other cases, multiple actuators 1102 are disposed in a housing. Additionally or alternatively, the housing may contain a battery, wireless communication circuitry, an amplifier, and a cooling system. For example, the housing may contain a fan, blower, or be in contact with a liquid jacket or gaseous cooling system. In some cases, the actuators 1002, 1004 communicate wirelessly with a controller. Each housing 1104 may be removable or detachable for sanitizing or other cleaning. The housing may be sealed with an O-ring. The O-ring may maintain the air integrity of the housing or mitigate contamination of the actuator within.

In the example of FIG. 11, the housing 1104 and actuators 1102 are attached to a shoe assembly 1106. The shoe assembly 1106 includes a footbed 1108 and calf support (or ankle brace) 1110 for each leg of the subject. In some cases, the housing 1104 and actuators 1102 may attach to the shoe 1106 at the underside of the footbed 1108. The footbed 1108 and calf support 1110 may have a pad to further support the foot of the subject. The pad may be disposable and replaced after use. Additionally or alternatively, the pad may be custom fit for each patient, for example, using a moldable material or an additive manufacturing technique. The shoe 1106, including the footbeds 1108 and calf supports 1110, may be configured to be attached to a patient bed, for example. The shoe 1106 or footbeds 1108 and calf supports 1110 may be color-coded to indicate the correct orientation of the shoe 1106 relative to the subject to medical personnel.

As shown in FIG. 11, the footbeds 1108 are joined by a link arrangement 1112. The link arrangement 1112 customizes the spacing of the footbeds 1108. In the example shown, the link arrangement 1112 includes a guide and a number of wingnuts to secure the guide in position. Other fasteners may be used.

The calf support 1110 may be integrally formed with or otherwise attached to the footbed 1108 of the shoe assembly 1106. For instance, the calf support 1110 may be integrally formed with an outer shell of the footbed 1108.

One or more slots or openings 1114 may be provided in the shoe assembly 1106 to provide attachment points for foot or other straps. The foot straps may be used to secure the feet of the subject within the shoe assembly 1106. In the example of FIG. 11, the slots 1114 are formed in each calf support 1110 and in sidewalls along each footbed 1108. The slots 1114 may be configured for attachment of straps or other elements associated with the compression links. The straps may secure the foot using a hook-and-loop fastener, snaps, a D-ring closure, or other fastener.

The shoe assembly 1106 may include one or more compression link receivers 1116. Each receiver 1116 provides an attachment point for a respective compression link. Each receiver 1116 includes a slot 1118 in which the compression link (or an end or other component thereof) is captured. Each receiver 1116 may be integrally formed with, or otherwise attached to, a respective one of the footbeds 1108. The receivers 1116 may alternatively or additionally be attached to other components of the shoe assembly 1106, such as a common frame or other support of the shoe assembly 1106. Each receiver 1116 may be configured to engage a respective compression link, such as the links described in connection with FIG. 10. Additionally or alternatively, each receiver 1116 may indirectly engage the compression link by connecting with a force measurement instrument or other element associated with the compression link.

The compression links may be secured to the shoe assembly 1106 by sliding a retainer, end, or other component of the compression link into an interior of the receiver 1116. The compression link may thus extend through the slot 1118. The retainer of the compression link may have a width greater than the width of the slot 1118 to secure the retainer in place. For example, the retainer may be or include a ring at the end of the compression link with a diameter larger than the slot 1118 but smaller than the inside of the hollow in the attachment point 1116. The ring may thus slide into the receiver 1116 with the compression link extending through the slot 1118 while being held in place by the retainer.

In one aspect, a method of vibration therapy includes disposing a plurality of actuators about a subject, each actuator of the plurality of actuators being configured to generate a respective vibration signal, each vibration signal applying a normal force to the subject, and controlling the plurality of actuators to generate a vibration signal, the respective vibration signal of each actuator of the plurality of actuators having a respective vibration characteristic, in which disposing the plurality of actuators includes orienting each actuator of the plurality of actuators such that the respective vibration signal propagates along a longitudinal axis of the subject for stimulation of the subject remote from the plurality of actuators.

In some cases, the method further includes applying a compressive force to the subject along the longitudinal axis of the subject. Alternatively or additionally, the method further includes receiving, via a sensor disposed about the subject, a measure of a mechanical or physiological response, and controlling the respective vibration characteristic of an actuator of the plurality of actuators based on the received measure. In some cases, the measure of mechanical or physiological response includes but is not limited to oxygen of tissue hemoglobin, oxygen consumption, electrical potential, or acceleration. Alternatively or additionally, the vibration characteristic of the vibration signal of a first actuator of the plurality of actuators differs from the vibration characteristic of the vibration signal of a second actuator of the plurality of actuators. In some cases, the vibration characteristic is a vibration frequency or a vibration amplitude. Alternatively or additionally, disposing the plurality of actuators according to the method further includes securing a harness arrangement to the subject, the harness arrangement configured to support the actuators oriented about the shoulders and plantar surfaces of the feet of the subject. Alternatively or additionally, disposing the plurality of actuators according to the method further includes connecting actuators oriented about the shoulders of the subject and actuators oriented about the plantar surfaces of the feet of the subject via a compression link extending around an arm of the subject and along the length of the subject.

In one aspect, a system for vibration therapy includes a plurality of actuators, each actuator of the plurality of actuators configured generate a respective vibration signal, each vibration signal applying a normal force to a subject, a harness arrangement configured to dispose the plurality of actuators about a longitudinal end of the subject and to orient each actuator of the plurality of actuators such that the respective vibration signal propagates along a longitudinal axis of the subject for stimulation of the subject remote from the plurality of actuators, and a controller in electrical communication with the plurality of actuators and configured to control a respective vibration characteristic of the respective vibration signal of each actuator of the plurality of actuators.

In some cases, the harness arrangement is further configured to dispose the actuators about the shoulders and plantar surfaces of the feet of the subject. Alternatively or additionally, the harness arrangement is further configured to apply a compressive force to the subject along the longitudinal axis of the subject. In some cases, a link attached to the harness arrangement is configured to apply the compressive force. In some cases, the harness arrangement further includes a compression link extending around an arm of the subject and along the length of the subject configured to connect the actuators disposed about the shoulders and the actuators disposed about the plantar surfaces of the feet of the subject. Alternatively or additionally, the system includes a sensor configured to measure a mechanical or physiological response, in which the controller is further configured to control the vibration characteristic of the vibration signal of an actuator of the plurality of actuators based on the received measure. In some cases, the measured mechanical or physiological response includes but is not limited to oxygen of tissue hemoglobin, tissue blood flow, nitric oxide production, oxygen consumption, muscle or nerve electrical potential, bone growth, heart rate variability, tissue carbon dioxide levels, tissue temperature, or acceleration. Alternatively or additionally, the vibration characteristic of the vibration signal of a first actuator differs from the vibration characteristic of the vibration signal of a second actuator. Alternatively or additionally, the vibration characteristic is a vibration frequency or a vibration amplitude.

In one aspect, a method of vibration therapy includes applying a compressive force to a subject along a longitudinal axis of the subject, disposing a plurality of actuators about a longitudinal end of the subject, each actuator of the plurality of actuators being configured to generate a respective vibration signal, each vibration signal applying a normal force to the subject, and controlling the plurality of actuators to generate a vibration signal, the respective vibration signal of each actuator of the plurality of actuators having a respective vibration characteristic, a respective vibration characteristic of a first actuator differing from a respective vibration characteristic of a second actuator, in which disposing the plurality of actuators includes orienting each actuator of the plurality of actuators such that the respective vibration signal propagates along a longitudinal axis of the subject for stimulation of the subject remote from the plurality of actuators.

In some cases, the compressive force is applied via a preloaded harness arrangement, disposing the plurality of actuators further includes disposing a first actuator of the plurality of actuators about the shoulders of a subject and disposing a second actuator of the plurality of actuators about the plantar surfaces of the feet of the subject, and controlling the plurality of actuators further includes exciting a first vibration signal with a first vibration characteristic frequency and amplitude via the first actuator of the plurality of actuators and a second vibration signal with a second vibration characteristic frequency and amplitude via the second actuator of the plurality of actuators. Alternatively or additionally, the method further includes receiving, via a sensor disposed about the subject, a measure of a mechanical or physiological response, and controlling the respective vibration characteristic of an actuator of the plurality of actuators based on the received measure.

While the present invention has been described with reference to specific examples, which are intended to be illustrative only and not to be limiting of the invention, it will be apparent to those of ordinary skill in the art that changes, additions and/or deletions may be made to the disclosed embodiments without departing from the spirit and scope of the invention.

The foregoing description is given for clearness of understanding only, and no unnecessary limitations should be understood therefrom, as modifications within the scope of the invention may be apparent to those having ordinary skill in the art.

What is claimed is:

1. A method of vibration therapy, the method comprising:

disposing a plurality of actuators about a subject disposed on a bed, each actuator of the plurality of actuators being configured to generate a respective vibration signal, each vibration signal applying a normal force to the subject, the plurality of actuators being separate from, and not attached to, the bed;

applying a compressive force to the subject along a longitudinal axis of the subject, the compressive force being applied by a compression link of a harness arrangement, the harness arrangement being separate from, and not attached to, the bed; and controlling the plurality of actuators such that the respective vibration signal of each actuator of the plurality of actuators has a respective vibration characteristic;

wherein disposing the plurality of actuators includes orienting each actuator of the plurality of actuators such that the respective vibration signal propagates along the longitudinal axis of the subject for stimulation of the subject remote from the plurality of actuators, wherein the compression link is adjustable in length to establish a level of the compressive force, and wherein disposing the plurality of actuators comprises securing the harness arrangement to the subject, the harness arrangement configured to support the actuators oriented about the shoulders and-plantar surfaces of the feet of the subject.

2. The method according to claim 1 wherein applying the compressive force to the subject along the longitudinal axis of the subject is implemented before application of the vibration signals such that the harness arrangement applies a preloading force.

3. The method according to claim 1 further comprising:

receiving, via a sensor disposed about the subject, a measure of a mechanical or physiological response, and controlling the respective vibration characteristic of an actuator of the plurality of actuators based on the measure of the mechanical or physiological response.

4. The method according to claim 3, wherein the measure of the mechanical or physiological response is tissue oxygen saturation, tissue blood flow, nitric oxide production, oxygen consumption, muscle or nerve electrical potential, bone growth, heart rate variability, tissue carbon dioxide levels, tissue temperature, or acceleration.

5. The method according to claim 1, wherein the vibration characteristic of the vibration signal of a first actuator of the plurality of actuators differs from the vibration characteristic of the vibration signal of a second actuator of the plurality of actuators.

6. The method according to claim 5, wherein the vibration characteristic is a vibration frequency or a vibration amplitude.

7. A method of vibration therapy, the method comprising:

disposing a plurality of actuators about a subject disposed on a bed, each actuator of the plurality of actuators being configured to generate a respective vibration signal, each vibration signal applying a normal force to the subject, the plurality of actuators being separate from, and not attached to, the bed;

applying a compressive force to the subject along a longitudinal axis of the subject, the compressive force being applied by a compression link of a harness arrangement, the harness arrangement being separate from, and not attached to, the bed; and controlling the plurality of actuators such that the respective vibration signal of each actuator of the plurality of actuators has a respective vibration characteristic;

wherein disposing the plurality of actuators includes orienting each actuator of the plurality of actuators such that the respective vibration signal propagates along the longitudinal axis of the subject for stimulation of the subject remote from the plurality of actuators, wherein the compression link is adjustable in length to establish a level of the compressive force, and wherein applying the compressive force comprises connecting a first actuator of the plurality of actuators at a shoulder of the subject with a second actuator of the plurality of actuators disposed at a foot of the subject via the compression link of the harness arrangement, the compression link extending along the longitudinal axis.

8. A system for vibration therapy, the system comprising:

a plurality of actuators, each actuator of the plurality of actuators configured to generate a respective vibration signal applying a normal force to a subject disposed on a bed, the plurality of actuators being separate from, and not attached to, the bed;

a harness arrangement configured to dispose the plurality of actuators at at least one longitudinal end of the subject and to orient each actuator of the plurality of actuators such that the respective vibration signal propagates along a longitudinal axis of the subject for stimulation of the subject remote from the plurality of actuators, the harness arrangement being separate from, and not attached to, the bed; and a controller in electrical communication with the plurality of actuators and configured to control a respective vibration characteristic of the respective vibration signal of each actuator of the plurality of actuators;

wherein the harness arrangement comprises a compression link, the compression link being configured to apply a compressive force to the subject along the longitudinal axis of the subject, wherein the compression link is adjustable in length to establish a level of the compressive force, and wherein the harness arrangement is further configured to dispose respective actuators of the plurality of actuators about shoulders and plantar surfaces of feet of the subject.

9. The system of claim 8, wherein the harness arrangement is configured to apply the compressive force to the subject along the longitudinal axis of the subject as a preloading force before application of the vibration signals.

10. The system of claim 8, wherein the compression link is configured to apply the compressive force only between a waist of the subject and feet of the subject, or only between the waist and shoulders of the subject.

11. A system for vibration therapy, the system comprising:

a plurality of actuators, each actuator of the plurality of actuators configured to generate a respective vibration signal applying a normal force to a subject disposed on a bed, the plurality of actuators being separate from, and not attached to, the bed;

a harness arrangement configured to dispose the plurality of actuators at at least one longitudinal end of the subject and to orient each actuator of the plurality of actuators such that the respective vibration signal propagates along a longitudinal axis of the subject for stimulation of the subject remote from the plurality of actuators, the harness arrangement being separate from, and not attached to, the bed; and a controller in electrical communication with the plurality of actuators and configured to control a respective vibration characteristic of the respective vibration signal of each actuator of the plurality of actuators;

wherein the harness arrangement comprises a compression link, the compression link being configured to apply a compressive force to the subject along the longitudinal axis of the subject, wherein the compression link is adjustable in length to establish a level of the compressive force, and wherein the compression link is configured to connect first and second actuators of the plurality of actuators disposed at a shoulder and a foot of the subject, respectively.

12. The system of claim 8 further comprising:

a sensor configured to measure a mechanical or physiological response, wherein the controller is further configured to control the vibration characteristic of the vibration signal of an actuator of the plurality of actuators based on the mechanical or physiological response.

13. The system of claim 12, wherein the measured mechanical or physiological response is tissue oxygen saturation, tissue blood flow, nitric oxide production, oxygen consumption, muscle or nerve electrical potential, bone growth, heart rate variability, tissue carbon dioxide levels, tissue temperature, or acceleration.

14. The system of claim 8, wherein the vibration characteristic of the vibration signal of a first actuator differs from the vibration characteristic of the vibration signal of a second actuator.

15. The system of claim 14, wherein the vibration characteristic is a vibration frequency or a vibration amplitude.

16. A method of vibration therapy, the method comprising:

applying a compressive force to a subject disposed on a bed along a longitudinal axis of the subject, the compressive force being applied by a compression link of a harness arrangement, the harness arrangement being separate from, and not attached to, the bed;

disposing a plurality of actuators at at least one longitudinal end of the subject, each actuator of the plurality of actuators being configured to generate a respective vibration signal applying a normal force to the subject, the plurality of actuators being separate from, and not attached to, the bed; and controlling the plurality of actuators such that the respective vibration signal of each actuator of the plurality of actuators has a respective vibration characteristic, a respective vibration characteristic of a first actuator differing from a respective vibration characteristic of a second actuator;

wherein disposing the plurality of actuators comprises orienting each actuator of the plurality of actuators such that the respective vibration signal propagates along the longitudinal axis of the subject for stimulation of the subject remote from the plurality of actuators, wherein the compression link is adjustable in length to establish a level of the compressive force, and wherein disposing the plurality of actuators further comprises disposing, by the harness arrangement, a first actuator of the plurality of actuators at a shoulder of the subject and a second actuator of the plurality of actuators at a foot of the subject.

17. The method according to claim 16, wherein:

applying the compressive force comprises connecting the first actuator with the second actuator via the compression link of the harness arrangement, the compression link extending along the longitudinal axis, and controlling the plurality of actuators comprises exciting a first vibration signal with a first vibration characteristic frequency and amplitude via the first actuator of the plurality of actuators and a second vibration signal with a second vibration characteristic frequency and amplitude via the second actuator of the plurality of actuators.

18. The method according to claim 16, further comprising:

receiving, via a sensor disposed about the subject, a measure of a mechanical or physiological response, and controlling the respective vibration characteristic of an actuator of the plurality of actuators based on the measure of the mechanical or physiological response.

* * * * *